US010195752B2

(12) United States Patent
Perlberg et al.

(10) Patent No.: US 10,195,752 B2
(45) **Date of Patent: *Feb. 5, 2019**

(54) SHAVING APPARATUS

(71) Applicant: Hybrid Razor LTD, Caesarea (IL)

(72) Inventors: Gil Perlberg, Zichron Yaakov (IL); Beni Nachon, Qiriat-Ata (IL); Shoham Zak, Givat Ela (IL); Gitay Kryger, Rosh Haayin (IL); Tsafrir Ben-Ari, Shimshit (IL)

(73) Assignee: HYBRID RAZOR LTD (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,312

(22) Filed: Dec. 1, 2017

(65) Prior Publication Data

US 2018/0079093 A1 Mar. 22, 2018

Related U.S. Application Data

(63) Continuation of application No. 14/891,881, filed as application No. PCT/IB2014/001886 on May 19, 2014, now Pat. No. 9,862,107.

(Continued)

(51) Int. Cl.
*B26B 19/18* (2006.01)
*B26B 21/34* (2006.01)

(52) U.S. Cl.
CPC ..... *B26B 19/18* (2013.01); *B26B 21/34* (2013.01)

(58) Field of Classification Search
CPC ..... B26B 19/18; B26B 21/34
See application file for complete search history.

(56) References Cited

U.S. PATENT DOCUMENTS

D190,325 S 5/1877 Pepin
911,472 A 2/1909 Brunacci
(Continued)

FOREIGN PATENT DOCUMENTS

CA 2787348 A1 7/2011
CA 2787348 C 5/2015
(Continued)

OTHER PUBLICATIONS

Corresponding Extended European Search Report for EP 17169111 dated Sep. 13, 2017.

(Continued)

*Primary Examiner* — Hwei C Payer
(74) *Attorney, Agent, or Firm* — The Belles Group, P.C.

(57) ABSTRACT

A shaving apparatus in which a rotary cutter and a fixed blade are used to shear a user's hairs therebetween during a shaving process. Rotation of the rotary cutter is driven by an electric motor. In certain embodiments, the rotary cutter comprises a cutting tube that comprises a plurality of apertures that are defined by cutting edges which form a closed-geometry. In other embodiments, a lubricating element is coupled to the rotary cutter. In further embodiments, the apertures are arranged in a pattern to control the number and selection of apertures that are capable of being active to shear hairs at any one time. In even further embodiments, the fixed blade is integrally formed with the housing of the head; the housing is formed by a plurality of flat plate segments; the rotary cutter is formed by a plurality of stacked flat plate segments; and/or the fixed blade can reciprocate.

18 Claims, 29 Drawing Sheets

Related U.S. Application Data

(60) Provisional application No. 61/941,240, filed on Feb. 18, 2014, provisional application No. 61/824,579, filed on May 17, 2013.

(56) References Cited

U.S. PATENT DOCUMENTS

| | | | | |
|---|---|---|---|---|
| 1,420,943 | A | 6/1922 | Philip | |
| 1,436,960 | A | 11/1922 | Jakubiec | |
| 1,981,202 | A | 11/1934 | Shipman | |
| 2,096,379 | A | 10/1937 | Peak | |
| 2,127,881 | A | 8/1938 | Morris | |
| 2,186,092 | A | 1/1940 | Benner | |
| 2,229,972 | A | 1/1941 | Holsclaw | |
| 2,281,789 | A | 5/1942 | Moskovics | |
| 2,281,922 | A | 5/1942 | Dalkowitz | |
| 2,342,291 | A | 2/1944 | Morelli | |
| 2,360,785 | A | 10/1944 | Mehl | |
| 2,474,027 | A | 6/1949 | Berger | |
| 2,524,822 | A | 10/1950 | Neidig | |
| 2,574,472 | A * | 11/1951 | Galvao | B26B 19/18 30/346.51 |
| 2,594,764 | A | 4/1952 | Charles et al. | |
| 2,601,721 | A | 7/1952 | Garrard et al. | |
| 2,839,829 | A | 6/1958 | Knapp | |
| 2,858,607 | A | 11/1958 | Kane | |
| 3,050,851 | A | 8/1962 | Negri | |
| 3,128,550 | A | 4/1964 | Miselli | |
| 3,381,373 | A | 5/1968 | Brown | |
| 3,431,643 | A | 3/1969 | Miceli | |
| 3,494,031 | A | 2/1970 | Sklenar | |
| 3,710,442 | A | 1/1973 | Meyer | |
| 3,829,966 | A | 8/1974 | Owens | |
| 4,043,036 | A | 8/1977 | Stevens, Sr. | |
| 4,151,645 | A | 5/1979 | Tietjens | |
| 4,802,281 | A | 2/1989 | Tietjens | |
| 4,807,359 | A | 2/1989 | Wijma | |
| 4,811,483 | A | 3/1989 | Bakker | |
| 4,811,484 | A | 3/1989 | Wijma | |
| 4,827,613 | A | 5/1989 | Bakker | |
| 4,884,338 | A | 12/1989 | Stewart | |
| 4,894,912 | A | 1/1990 | Tietjens | |
| 5,022,154 | A | 6/1991 | Johnson | |
| 5,035,053 | A | 7/1991 | Hoekstra | |
| 5,367,599 | A | 11/1994 | Okada | |
| 5,377,699 | A | 1/1995 | Varnum | |
| 5,921,134 | A | 7/1999 | Shiba | |
| 6,442,840 | B2 | 9/2002 | Zucker | |
| 6,568,083 | B1 | 5/2003 | Taniguchi | |
| 7,367,126 | B2 | 5/2008 | Freund | |
| 7,446,495 | B2 | 11/2008 | Tse | |
| 7,703,209 | B2 | 4/2010 | Freund | |
| 8,033,022 | B2 * | 10/2011 | Ben-Ari | B26B 21/34 30/42 |
| 8,561,301 | B2 | 10/2013 | Schnak | |
| 8,601,696 | B2 | 12/2013 | Ben-Ari | |
| 8,661,687 | B2 | 3/2014 | Rebaudieres | |
| 8,667,692 | B2 | 3/2014 | Kraus | |
| 8,887,401 | B2 | 11/2014 | Oxford | |
| 9,862,107 | B2 * | 1/2018 | Perlberg | B26B 21/34 |
| 2002/0055695 | A1 | 5/2002 | Takahata | |
| 2002/0108251 | A1 | 8/2002 | Brum | |
| 2005/0000093 | A1 | 1/2005 | Shagalov | |
| 2006/0218793 | A1 | 10/2006 | Zucker | |
| 2007/0220755 | A1 | 9/2007 | Dror | |
| 2008/0060202 | A1 | 3/2008 | Oh | |
| 2011/0173816 | A1 | 7/2011 | Ben-Ari | |
| 2011/0197726 | A1 | 8/2011 | Kraus | |
| 2011/0314677 | A1 | 12/2011 | Meier | |
| 2012/0000075 | A1 * | 1/2012 | Ben-Ari | B26B 19/18 30/43.6 |
| 2012/0227554 | A1 | 9/2012 | Beech | |
| 2014/0096397 | A1 | 4/2014 | Ben-Ari | |
| 2014/0137714 | A1 | 5/2014 | Krenik | |
| 2016/0167241 | A1 | 6/2016 | Goldfarb | |
| 2016/0375595 | A1 | 12/2016 | Mintz | |
| 2017/0057103 | A1 * | 3/2017 | Perlberg | B26B 21/34 |
| 2017/0136636 | A1 | 5/2017 | Zak | |
| 2018/0079093 | A1 * | 3/2018 | Perlberg | B26B 19/18 |

FOREIGN PATENT DOCUMENTS

| | | | |
|---|---|---|---|
| DE | 2503175 | | 7/1975 |
| EP | 2525949 | B1 | 8/2017 |
| EP | 2810579 | B1 | 8/2017 |
| EP | 3328430 | A1 | 10/2017 |
| FR | 1556327 | | 2/1969 |
| FR | 2126486 | | 10/1972 |
| GB | 2294228 | | 4/1996 |
| WO | 2011086474 | | 7/2011 |
| WO | 2014191844 | A2 | 12/2014 |
| WO | 2014191844 | A3 | 7/2015 |
| WO | 2015125021 | A3 | 1/2016 |
| WO | WO 2017/182872 | A1 * | 10/2017 |

OTHER PUBLICATIONS

References cited in Office Action dated Feb. 2, 2018 in Corresponding U.S. Appl. No. 15/119,821. US.

* cited by examiner

SHAVING APPARATUS

CROSS-REFERENCE TO RELATED PATENT APPLICATIONS

The present application is a continuation of U.S. patent application Ser. No. 14/891,881, filed Nov. 17, 2015, now U.S. Pat. No. 9,862,107, which is a U.S. national stage application under 35 U.S.C. § 371 of International Patent Application Serial No. PCT/IB2014/001886, filed May 19, 2014, which claims the benefit of U.S. Provisional Patent Application Ser. No. 61/941,240, filed Feb. 18, 2014, and U.S. Provisional Patent Application Ser. No. 61/824,579, filed May 17, 2013, the entireties of which are hereby incorporated by reference.

BACKGROUND

The present invention relates generally to shaving apparatus, and specifically shaving apparatus that utilize a shearing technique to cut hair bristles between a rotary cutter and a fixed blade.

The current methods for removing hair from the human body, by shaving, as opposed to epilation, involve two basic approaches: the razor approach, wherein a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the sharp razor blade approach, the energy for cutting is provided by the hand driving the razor across the skin of the user, typically by the hand of the user him/herself. The conditions of cutting hair are a compromise between the ease of cutting a soft (or softened) hair (or hair bristle) and having the necessary counter-force against the blade's force which can only come from the hardness of the hair bristle. Apart from being a compromise difficult to optimize daily on a variety of hair bristles, the sharpness of the blade and its angle pose a constant risk of nicks and cuts, as the blade is driven forcefully across the skin.

In the screen approach of most motorized shaving apparatus, the problem of safety is mitigated since the skin and the cutting elements are separated by the screen. Moreover, the hair bristles which penetrate the screen through its holes are given a prop to be cut against; hence, the lack of a counter-force for cutting is also mitigated to some extent. However, in order to arrive at an efficient cutting condition, the hair bristle must enter a hole and be perpendicular to the skin, requirements which are not always met unless the screen is constantly moved across the skin. Still, when the hair bristle is eventually cut at the optimal angle, it cannot be cut close to the skin due to the separating screen.

One cutting technique which requires minimal force for cutting hair can be effected by scissors. Scissors cut hair at the crossing point of two blades which do not have to be very sharp in order to cut the hair due to the fact that the blades contact the hair from substantially opposite directions in the plane of cutting, mutually providing each other with a counter-force for cutting. While it is impractical to use scissors for daily shaving, which requires maximal closeness of the cutting point to the skin, the scissors cutting technique was implemented in the form of rotary cutter units cutting hair against a flat and straight stationary blade. This hair cutting technique is capable of providing a very close shave since the cutting blades are positioned flush against the skin at the time of cutting. This also renders this cutting approach relatively safe from accidental cuts.

However, the presently known configurations which have attempted to implement this technique have suffered from a number of drawbacks.

BRIEF SUMMARY OF THE INVENTION

The invention, in one aspect, is directed to a shaving apparatus in which a rotary cutter and a fixed blade are used to shear a user's hairs there between during a shaving process. Rotation of the rotary cutter is driven by an electric motor and the rotary cutter comprises a cutting tube that comprises a plurality of apertures that are defined by cutting edges which form a closed-geometry. The cutting tube may be a tubular screen comprising one or more lattice structures.

In one such embodiment, the invention can be a shaving apparatus comprising: a handle portion, a power source, and a head portion coupled to the handle portion. The head portion may comprise a rotary cutter and a fixed blade. The rotary cuter may comprise a cutter tube that comprises a plurality of apertures in an outer surface of the cutter tube. Each of the apertures may be defined by a cutting edge having a closed-geometry. The fixed blade has a cutting edge and is mounted adjacent the rotary cutter. An electric motor is operably coupled to the power source and the rotary cutter. The electric motor may be operated to rotate the rotary cutter about an axis so that a user's hairs are sheared between the cutting edge of the fixed blade and the cutting edges of the cutter tube.

In another such embodiment, the invention can be a shaving apparatus comprising: a handle portion, a power source, a head portion coupled to the handle portion, and an electric motor. The electric motor is operably coupled to the power source and a rotary cutter to rotate the rotary cutter about an axis. The head portion is coupled to the handle portion and comprises the rotary cutter. The rotary cutter comprises a cutter tube that comprises one or more apertures in an outer surface of the cutter tube, the aperture defined by a cutting edge having a closed-geometry. The head portion further comprises a fixed blade having a cutting edge. The fixed blade is mounted adjacent the rotary cutter so that a user's hairs are sheared between the cutting edge of the fixed blade and the cutting edge of the cutter tube when the rotary cutter is rotating.

In another aspect, the invention is directed to a shaving apparatus in which a rotary cutter and a fixed blade are used to shear a user's hairs there between during a shaving process. Rotation of the rotary cutter is driven by an electric motor and a lubricating element is coupled to the rotary cutter for rotation therewith, such that the lubricating element contacts the user's skin and/or applies a lubricant to the user's skin during the shaving process.

In one such embodiment, the invention can be a shaving apparatus comprising a handle portion, a power source, and a head portion coupled to the handle portion. The head portion may comprise a rotary cutter comprising a plurality of cutting edges and at least one lubricating element coupled to the rotary cutter for rotation therewith. The head portion may also comprise a fixed blade having a cutting edge. The fixed blade is mounted adjacent the rotary cutter. An electric motor is operably coupled to the power source and the rotary cutter. When activated, the electric motor rotates the rotary cutter about an axis so that: (1) the lubricating element applies a lubricant to a user's skin when the rotary cutter is rotating, or contacts the user's skin; and (2) the user's hairs are sheared between the cutting edge of the fixed blade and the cutting edges of the rotary cutter when the rotary cutter is rotating.

In a further embodiment, the invention may be a shaving apparatus comprising a handle portion, a power source, and a head portion coupled to the handle portion. The head portion may comprise a rotary cutter comprising a cutter tube that comprises a plurality of apertures in an outer surface of the cutter tube, each of the apertures defined by a cutting edge having a closed-geometry. The head portion may further comprise at least one lubricating element coupled to the cutter tube for rotation therewith and a fixed blade having a cutting edge, the fixed blade mounted adjacent the rotary cutter. An electric motor is operably coupled to the power source and the rotary cutter. When activated, the electric motor rotates the rotary cutter about an axis so that: (1) the lubricating element contacts a user's skin when the rotary cutter is rotating, or applies a lubricant to the user's skin; and (2) the user's hairs are sheared between the cutting edge of the fixed blade and the cutting edges of the rotary cutter when the rotary cutter is rotating.

In another aspect, the invention is directed to a shaving apparatus in which a rotary cutter and a fixed blade are used to shear a user's hairs there between during a shaving process. Rotation of the rotary cutter is driven by an electric motor and the rotary cutter. The outer surface of the rotary cutter is provided with a plurality of apertures defined by a cutting edge having a closed-geometry and comprising a shearing portion and a non-shearing portion. The apertures are arranged in a pattern on the outer surface of the rotary cutter so that only a selected number of shearing portions are capable of actively shearing hairs with the fixed blade at any given time.

In one such embodiment, the invention can be a shaving apparatus comprising: a handle portion; a power source; an electric motor operably coupled to the power source and a rotary cutter to rotate the rotary cutter about a rotational axis; a head portion coupled to the handle portion, the head portion comprising: the rotary cutter, the rotary cutter comprising a plurality of apertures in an outer surface of the rotary cutter, each of the apertures defined by a cutting edge having a closed-geometry and comprising a shearing portion and a non-shearing portion; a fixed blade having a cutting edge, the fixed blade mounted adjacent the rotary cutter so that a user's hairs are sheared between the cutting edge of the fixed blade and the shearing portions of the cutting edges of the cutter tube when the rotary cutter is rotating; and the apertures arranged in a pattern so that no more than two of the shearing portions are capable of being active in shearing the user's hair with the cutting edge of the fixed blade when the rotary cutter is rotating.

In another such embodiment, the invention can be a shaving apparatus comprising: a handle portion; a power source; an electric motor operably coupled to the power source and a rotary cutter to rotate the rotary cutter about a rotational axis; a head portion coupled to the handle portion, the head portion comprising: the rotary cutter, the rotary cutter comprising a plurality of apertures in an outer surface of the rotary cutter, each of the apertures defined by a cutting edge having a closed-geometry and comprising a shearing portion and a non-shearing portion; a fixed blade having a cutting edge, the fixed blade mounted adjacent the rotary cutter so that a user's hairs are sheared between the cutting edge of the fixed blade and the shearing portions of the cutting edges of the rotary cutter when the rotary cutter is rotating; and the apertures arranged in a pattern so that a projected reference line of the cutting edge of the fixed blade on the outer surface of the cutting tube intersects no more than two of the shearing portions irrespective of angular position of the rotary cutter.

In yet another such embodiment, the invention can be a shaving apparatus comprising: a handle portion; a power source; an electric motor operably coupled to the power source and a rotary cutter to rotate the rotary cutter about a rotational axis; a head portion coupled to the handle portion, the head portion comprising: the rotary cutter, the rotary cutter comprising a plurality of apertures in an outer surface of the rotary cutter, each of the apertures defined by a cutting edge having a closed-geometry and comprising a shearing portion and a non-shearing portion, the shearing portion comprising an apex; a fixed blade having a cutting edge, the fixed blade mounted adjacent the rotary cutter so that a user's hairs are sheared between the cutting edge of the fixed blade and the shearing portions of the cutting edges when the rotary cutter is rotating; and the apertures arranged in a pattern so that a projected reference line of the cutting edge of the fixed blade on the outer surface of the cutting tube intersects no more than two of the apexes irrespective of angular position of the rotary cutter.

In still another such embodiment, the invention can be a shaving apparatus comprising: a handle portion; a power source; an electric motor operably coupled to the power source and a rotary cutter to rotate the rotary cutter about a rotational axis; a head portion coupled to the handle portion, the head portion comprising: the rotary cutter, the rotary cutter comprising a plurality of apertures in an outer surface of the rotary cutter, the plurality of apertures arranged in a pattern comprising at least one row of the apertures, each of the apertures defined by a cutting edge having a closed-geometry and comprising a shearing portion and a non-shearing portion; a fixed blade having a cutting edge, the fixed blade mounted adjacent the rotary cutter so that a user's hairs are sheared between the cutting edge of the fixed blade and the shearing portions of the cutting edges of the rotary cutter when the rotary cutter is rotating; and the pattern configured so that a projected reference line of the cutting edge of the fixed blade on the outer surface of the cutting tube intersects at least one of the shearing portions of the apertures in the row and does not intersect at least one of the shearing portions of the apertures in the row.

In a further aspect, the invention may be a shaving apparatus comprising: a handle portion; a power source; a head portion coupled to the handle portion, the head portion comprising: a housing having an internal cavity, a rotary cutter comprising a plurality of cutting edges, the rotary cutter mounted within the internal cavity of the housing, the housing comprising an elongated slot that forms a passageway into the internal cavity of the housing and exposes a portion of the rotary cutter; a fixed blade that is an integrally formed as a portion of the housing and comprises a cutting edge that partially defines the elongated slot; and an electric motor operably coupled to the power source and the rotary cutter to rotate the rotary cutter about a rotational axis so that a user's hairs are sheared between the cutting edge of the fixed blade and the cutting edges of the rotary cutter.

In an even further aspect, the invention can be a shaving apparatus comprising: a handle portion; a power source; a head portion coupled to the handle portion, the head portion comprising: a plurality of flat plate ring segments arranged in a stack so to collectively form a rotary cutter comprising a plurality of cutting edges; and a fixed blade having a cutting edge, the fixed blade mounted adjacent the rotary cutter; and an electric motor operably coupled to the power source and the rotary cutter to rotate the rotary cutter about a rotational axis so that a user's hairs are sheared between the cutting edge of the fixed blade and the cutting edges of the rotary cutter.

In a still further aspect, the invention can be a shaving apparatus comprising: a handle portion; a power source; a head portion coupled to the handle portion, the head portion comprising: a plurality of flat plate segments arranged in a stack to collectively form a housing having an internal cavity, a rotary cutter comprising a plurality of cutting edges, the rotary cutter mounted within the internal cavity of the housing, the housing comprising an elongated slot that forms a passageway into the internal cavity of the housing and exposes a portion of the rotary cutter; a fixed blade comprises a cutting edge that partially defines the elongated slot; and an electric motor operably coupled to the power source and the rotary cutter to rotate the rotary cutter about a rotational axis so that a user's hairs are sheared between the cutting edge of the fixed blade and the cutting edges of the rotary cutter.

In a still further aspect, the invention can be a shaving apparatus comprising: a handle portion; a power source; a head portion coupled to the handle portion, the head portion comprising: a rotary cutter comprising an outer surface comprising peaks and valleys; and a fixed blade having an undulating cutting edge comprising peaks and valleys, the fixed blade mounted adjacent the rotary cutter so that the peaks of the undulating edge of the fixed blade nest in the valleys of the rotary cutter while the peaks of the rotary cutter nest in the valleys of the undulating edge of the fixed blade; and an electric motor operably coupled to the power source and the rotary cutter to rotate the rotary cutter about a rotational axis so that a user's hairs are sheared between the undulating cutting edge of the fixed blade and the rotary cutter.

In an even further aspect, the invention can be a shaving apparatus comprising: a handle portion; a power source; a head portion coupled to the handle portion, the head portion comprising: a rotary cutter; and a fixed blade having a cutting edge, the fixed blade mounted adjacent the rotary cutter so as to be capable of reciprocating translational movement in directions parallel to a rotational axis of the rotary cutter; and an electric motor operably coupled to the power source and the rotary cutter to rotate the rotary cutter about a rotational axis so that a user's hairs are sheared between the cutting edge of the fixed blade and the cutting edges of the rotary cutter.

Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION

Figure 1:
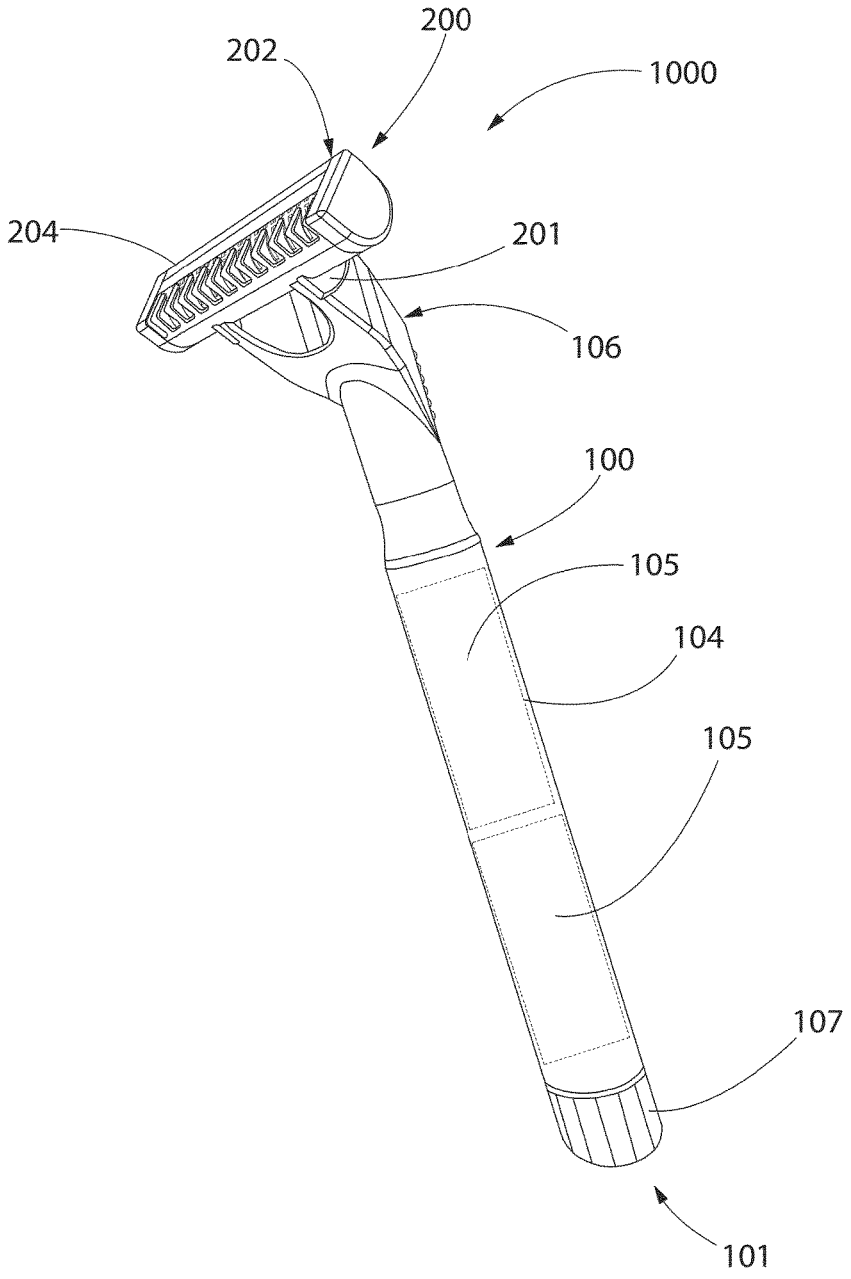
FIG. 1 is a front perspective view of a shaving apparatus according to the present invention.

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Additionally, as used herein, when any two items or axes are said to be "parallel" to "perpendicular" to one another, these terms are intended to include instances where the items or axes are not perfectly "parallel" to "perpendicular" due to tolerances, which may be 1-3° in certain instance.

Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
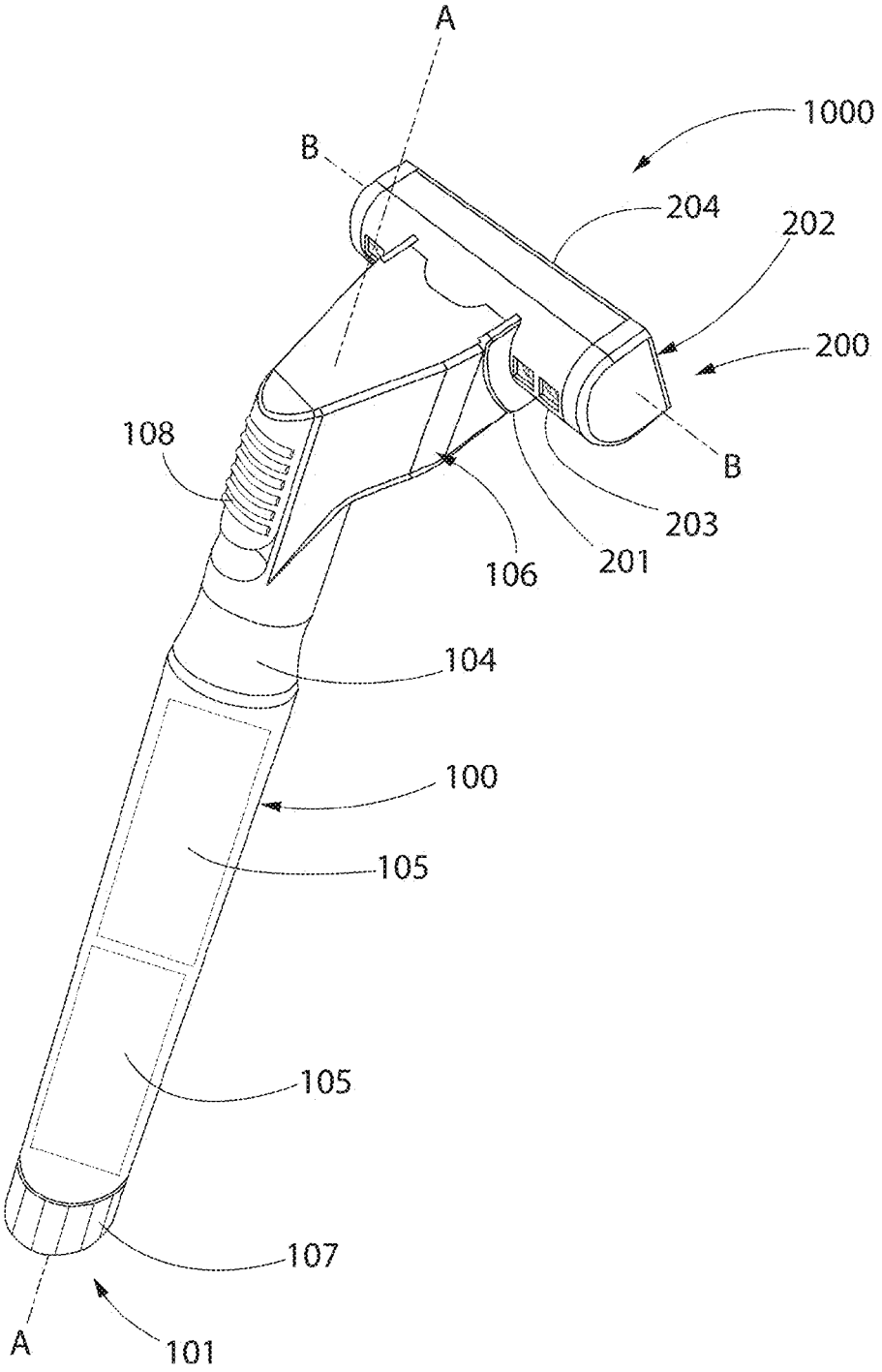
FIG. 2 is a rear perspective view of the shaving apparatus of FIG. 1.

Referring first to FIGS. 1 and 2 concurrently, a shaving apparatus 1000 according to an embodiment of the present invention is illustrated. The shaving apparatus 1000 generally comprises a handle portion 100 (hereinafter referred to as the "handle") and a head portion 200 (hereinafter referred to as the "head"). The handle 100 provides the user of the shaving apparatus 1000 with the necessary structure to comfortably and firmly grip and maneuver the shaving apparatus 1000 in the manner necessary to shave a desired area of skin. In the exemplified embodiment, the handle 100 is an elongated structure that comprises a generally cylindrical portion 104 for gripping and a mounting member 106 for coupling of the head 200 to the handle 100. In one embodiment, the handle 100 has a length between 70 mm to 140 mm.

The cylindrical portion 104 extends along the longitudinal axis A-A. In one embodiment, the cylindrical portion 104 of the handle 100 has a diameter of between 10 mm to 25 mm. The mounting member 106 is coupled to a distal end of the cylindrical portion 104 and extends radially away from the longitudinal axis A-A in an inclined manner. The distal end of the mounting member 106 is configured so that the head 200 can be coupled thereto. The head 200 can be coupled to the mounting member 106 in a permanent, semi-permanent, or detachable manner. For example, the head 200 could be integrally formed with the mounting member 106, thereby creating a permanent coupling. Alternatively, the head 200 could be coupled to the mounting member 106 via ultrasonic welding, thermal welding, soldering, adhesion or combinations thereof, thereby creating a semi-permanent coupling. In still other embodiments, the head 200 could be coupled to the mounting member 106 via a snap-fit connection, a mechanical interlock, an interference fit, a threaded connection, a tab/slot interlock, a latch, or combinations thereof, thereby creating a detachable coupling. Of course, other coupling techniques are contemplated and are considered to be within the scope of the invention. Moreover, in certain other embodiments of the invention, the mounting member 106 can be less prominent or omitted all together so that the head 200 is directly coupled to the cylindrical portion 104 in any of the manners described above or otherwise contemplated.

As will be appreciated by the skilled artisan, an attempt to arrive at a minimal size and weight of a battery-powered motorized shaving apparatus may end at the size limitation of the battery which can power the motor effectively so as to deliver the required effect for the required time period. When achieving a reduction of the work-load of the motorized element and making its action more efficient, one can then reduce the overall size limitations imposed also of the power source, namely the battery or batteries. As presented herein below, the shaving head according to some embodiments of the present invention is designed such that its scissors-like shaving action can be effected by a small motor, which can therefore be powered by a correspondingly small power source, compared to presently known configurations.

In the exemplified embodiment, the handle 100 also acts as a water-tight housing for a power source 105 (shown in dotted lines) that powers the motor 400 that rotates the rotary cutter 300 of the head 200 (the details of which will be discussed in greater detail below). Of course, in other embodiments, the power source 105 may be housed elsewhere in the shaving apparatus 1000. For example, in certain alternate embodiments, the power source 105 may be housed entirely or at least partially within the head 200. The power source 105 can be in the form of one or more batteries as is known in the art. In the exemplified embodiment, the batteries are disposed on and extend along the longitudinal axis A-A of the handle 100. Of course, alternative types of power sources can be utilized to power the motor 400 as desired. The exact type of power source 105 utilized in the shaving apparatus 1000 will depend on the power requirements of the motor 400 and, thus, is not to be considered limiting of the present invention unless specifically stated otherwise in the claims.

The power source 105 could be replaceable or permanent. In embodiments in which a removable power source 105 is used, the power source 105 may be one or more batteries that could be removed from the handle 100 for replacement or recharging. In such an embodiment, the handle 100 will further comprise the necessary structure to access the chamber of the handle 100 in which the power source 105 is located. In the exemplified embodiment, a removable cap 107 is provided at the proximal end 101 of the handle 100. The removable cap 107 can be coupled to the cylindrical portion 104 of the handle 100 via a threaded connection, a tight-fit assembly, or other connection technique that would create a fluid tight boundary so that water could not enter the chamber in which the power source 105 is located. In alternate embodiments, access to the internal chamber of the handle 100 in which the power source 105 is disposed can be accomplished via a hinged panel, a latch, a removable panel or any other structure as would be known to one of skill in the art.

In embodiments where a permanent (or non-removable) battery is used, the handle 100 may further comprise an electrical port to which a power cord could be electrically coupled to recharge the power source 105. To prevent water or other fluids from entering the electrical port, the electrical port may be provided behind a removable access panel or be provided with a cap/plug that seals the electrical port.

In still other embodiments, the power source may be external to the handle 100 of head 200, such as an electrical supply from a wall socket or other source of electricity. In one such embodiment, the handle 100 or head 200 may include a port or other mechanism for operably coupling to the external power source, such as to a first end of a power plug.

In the exemplified embodiment, the motor 400 is located within the head 200 of the shaving apparatus 1000 and, more specifically, within a central cavity of the rotary cutter 300. In certain other embodiments, however, the motor 400 may be located partially or entirely within the handle 1000. In such embodiments, the drive shaft of the motor 400 may be operably coupled to the rotary cutter 400 via gears, pulleys, belts, and other couplers capable of transmitting rotational motion.

A switch 108 is provided on the handle 100 for manually controlling the energization of the motor 400. While the switch 108 is exemplified as a manual slide switch, the switch could be any type of manual or automatic switch as would be known by those of skill in the art. In addition to the switch 108, control circuitry for controlling the performance characteristics of the motor 400 may also be located within the chamber of the handle 100 as desired.

As mentioned above, the head 200 is coupled to the distal end of the mounting member 106 of the handle 100. The head 200 has a generally elongated shape and extends along the longitudinal axis B-B. As discussed in detail below, the longitudinal axis B-B of the head 200 also serves as the axis of rotation of the rotary cutter 300. In the exemplified embodiment, when the head 200 is coupled to the handle 100, the head 200 is substantially perpendicular to the handle 100. More specifically, when the head 200 is coupled to the handle 100, the longitudinal axis B-B of the head 200 is substantially perpendicular to the longitudinal axis A-A of the handle 100. Moreover, the handle 200 is coupled to the center of the head 200 so that the shaving apparatus 1000 has a generally T-shape.

It is to be noted that only one potential structural manifestation of the head 200 and handle 100 are exemplified. It is to be understood, however, that the head 200 and handle 100 can take on a wide variety of shapes and sizes in other embodiments. For example, in certain embodiments, the head 200 may not be such a distinctive element than that of the handle 100. For example, the head 200 may simply be a distal or side portion of the handle 100 that can contact the user's skin. In one embodiment, the combination of the head 200 and handle 200 can form, without limitation, a cylindrical structure, a bulbous structure, or an egg-shaped structure.

In the exemplified embodiment, the head 200 is coupled to the handle 100 through the use of fastener elements 201 that extend from a tubular housing 202 of the head 200. The fastener elements 201 are plates that extend from a rear face 203 of the head 200 opposite the front face 204 of the head 200, wherein the front face 204 can be considered the working/cutting face of the head 200 as described below. The fastener elements 201 matingly engage corresponding structure on the mounting member 106 of the handle 100. Of course, the fastener elements 201 can take on a wide variety of structures, including pins, tangs, sockets, or other coupling or mating structures. In certain other embodiments, the head 200 may be pivotally connected to the handle 100 so that the orientation of the head 200 can be pivoted with respect to the handle 100. Thought of another way, in such an arrangement, the head 200 can be pivoted so that the longitudinal axis B-B of the head 200 can be moved in along an arcuate path relative to the longitudinal axis A-A of the handle 100. Such pivotal movement can be accomplished in a variety of manners. In one embodiment, the fastener elements 201 of the head 200 pivotally couples the head 200 to the mounting member 106. In another embodiment, the mounting member 106 is pivotally coupled to the cylindrical portion 104 of the handle 100. Pivotally coupling the head 200 to the handle 100 enables the front face 204 of the head 200 to be pivoted to any desired position with respect to the handle 100 during use of the shaving apparatus 1000, thereby allowing the user a greater degree of flexibility and the ability to shave complex contours and/or hard to reach places.

The pivotal coupling of the head 200 to the handle 100 allows the head 200 to swivel (i.e., rock) within a limited angle range about the longitudinal axis A-A of the handle. Such pivotal rotation allows the head 200 to adjust its position relative to the plane of motion and the skin of a user during use of the shaving apparatus 1000. Such pivotal motion can be limited, by mechanical means in the attachment mechanism and/or the handle 100 and/or the head 200, to a desired angle of rotation. In certain embodiments, the angle of rotation may be 180 degrees, 90 degrees, 60 degrees, 30 degrees or less than 30 degrees.

Figure 9:
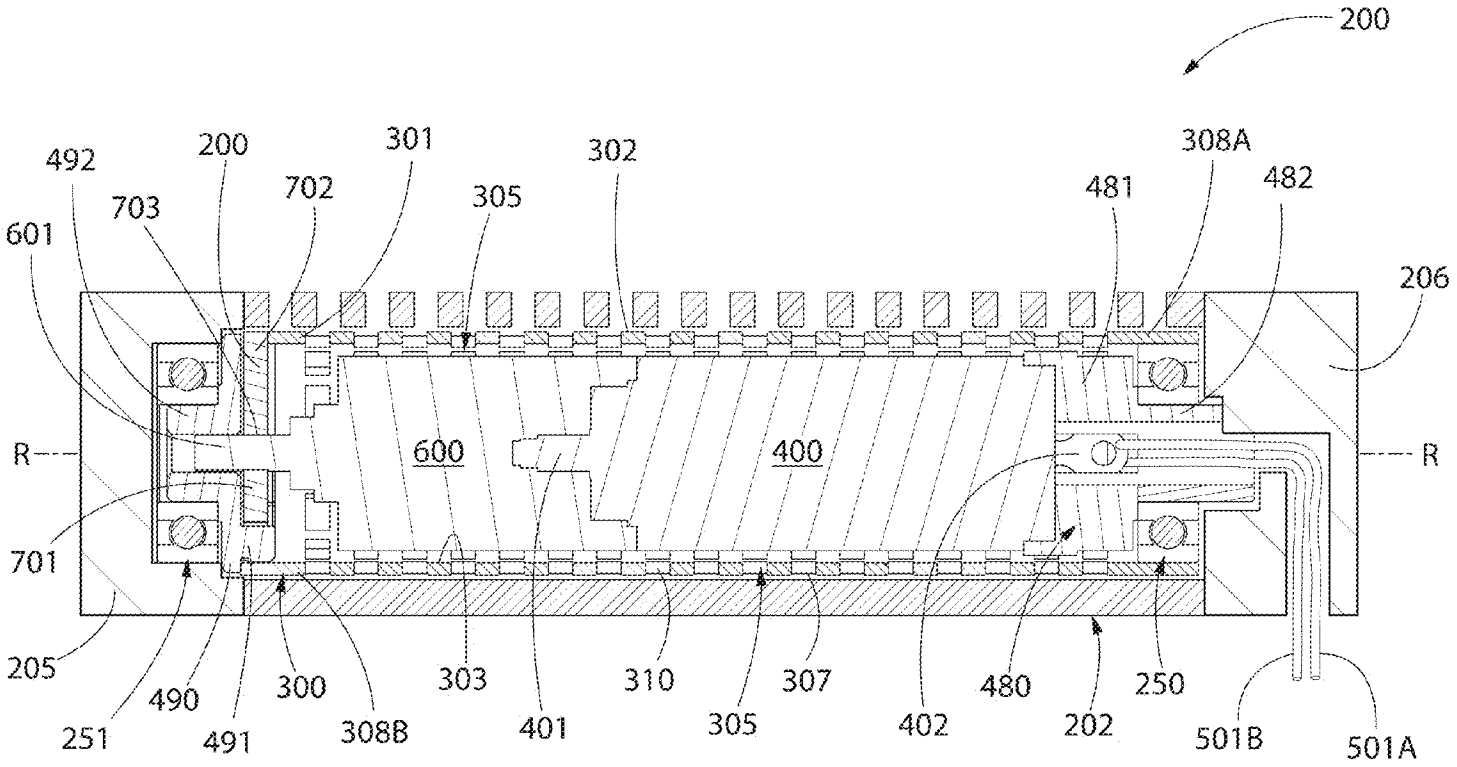
FIG. 9 is cross-sectional view of the head portion of the shaving apparatus of FIG. 1 taken along axis B-B of FIG. 2.

As mentioned above, in certain alternate embodiments, the head 200 will be detachably coupled to the handle 100. In such embodiments, the head 200 can be sold as a "refill" head for the handle 100. As mentioned above (and discussed in greater detail below with respect to FIGS. 4 and 9), the motor 400 may be located within the rotary cutter 300 of the head 200 in certain embodiments. Moreover, as discussed above, the power source 105 is located within the handle 100. Thus, a continuous electrical connection extends from the power source 105 in the handle 100 to the motor 400 in the head 200 in order to power the motor 400 during use.

Therefore, in embodiments where the head 200 is detachably coupled to the handle 100 and the motor is located within the head 200, electrical interface connectors (i.e., contacts) will be provided at appropriate positions on both the handle 100 and the head 200 that come into electrical coupling with one another when the head 200 is coupled to the handle 100, thereby completing the electrical circuit.

Figure 3:
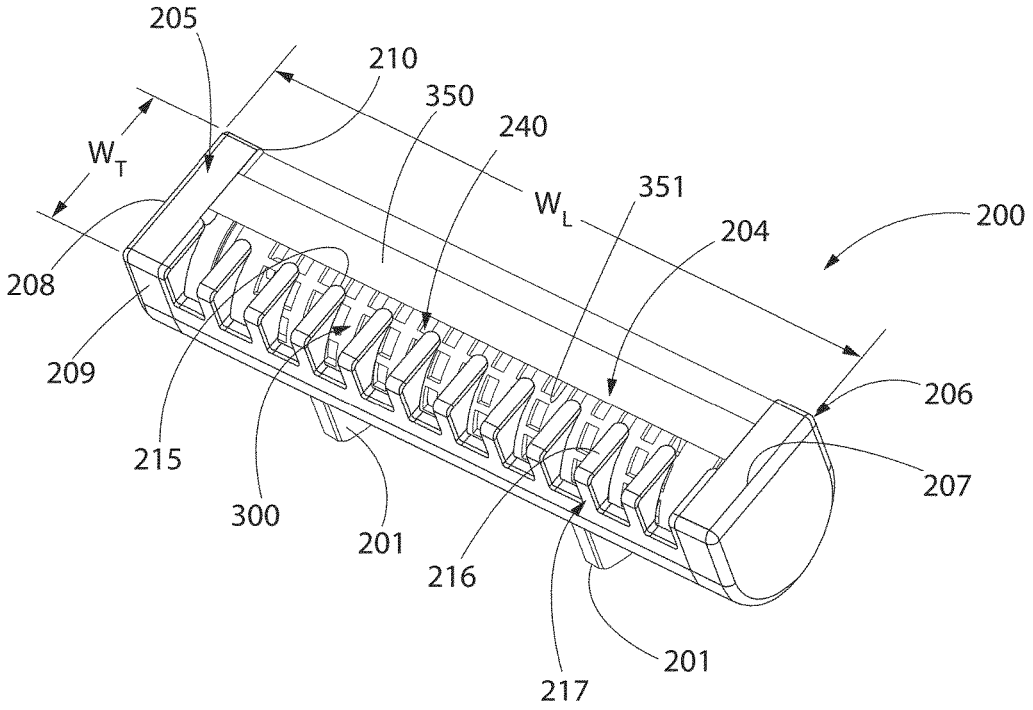
FIG. 3 is a top perspective view of a head portion of the shaving apparatus of FIG. 1.
Figure 4:
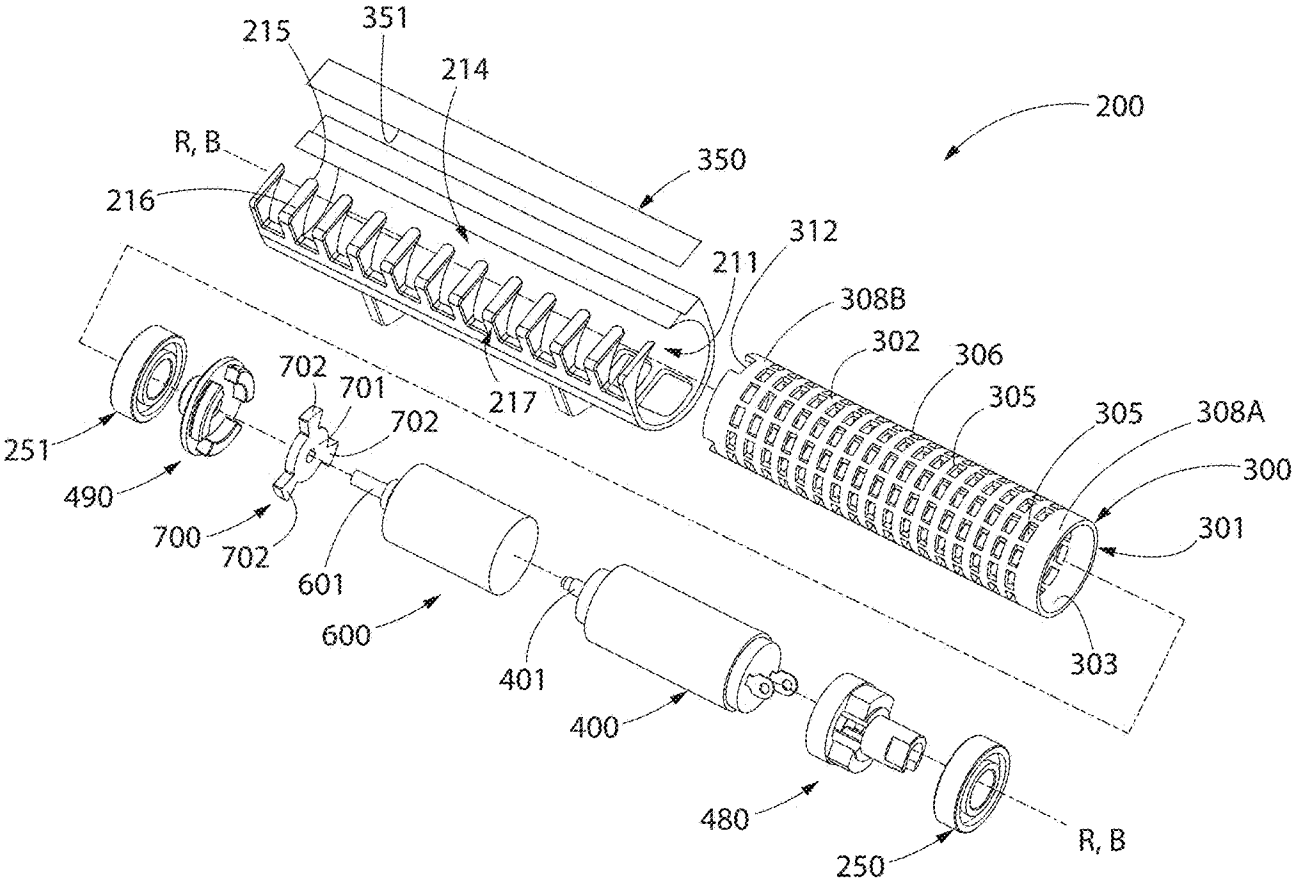
FIG. 4 is an exploded view of the head portion of the shaving apparatus of FIG. 1.
Figure 5:
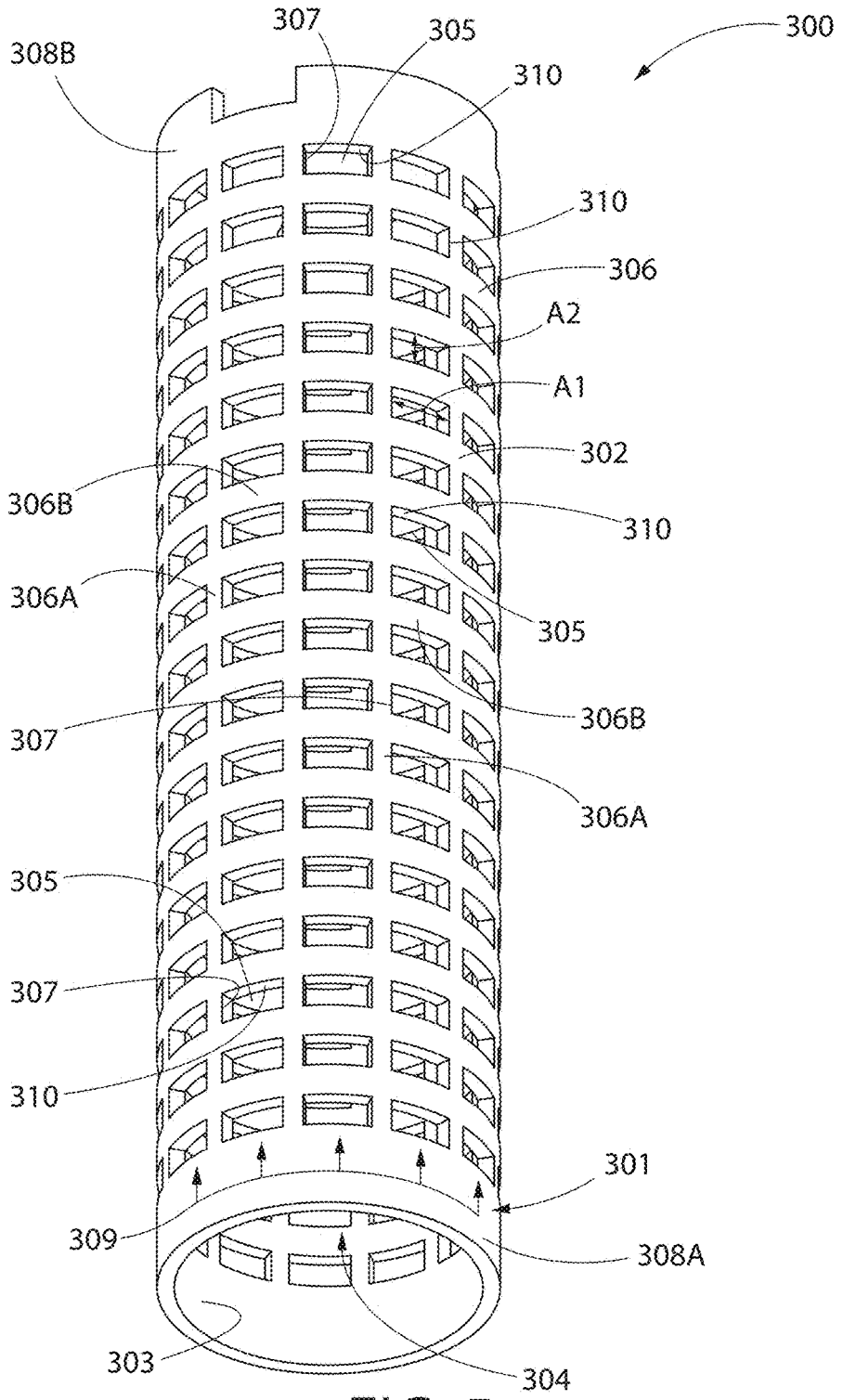
FIG. 5 is a perspective view of the rotary cutter of the shaving apparatus of FIG. 1 according to the present invention.
Figure 6:
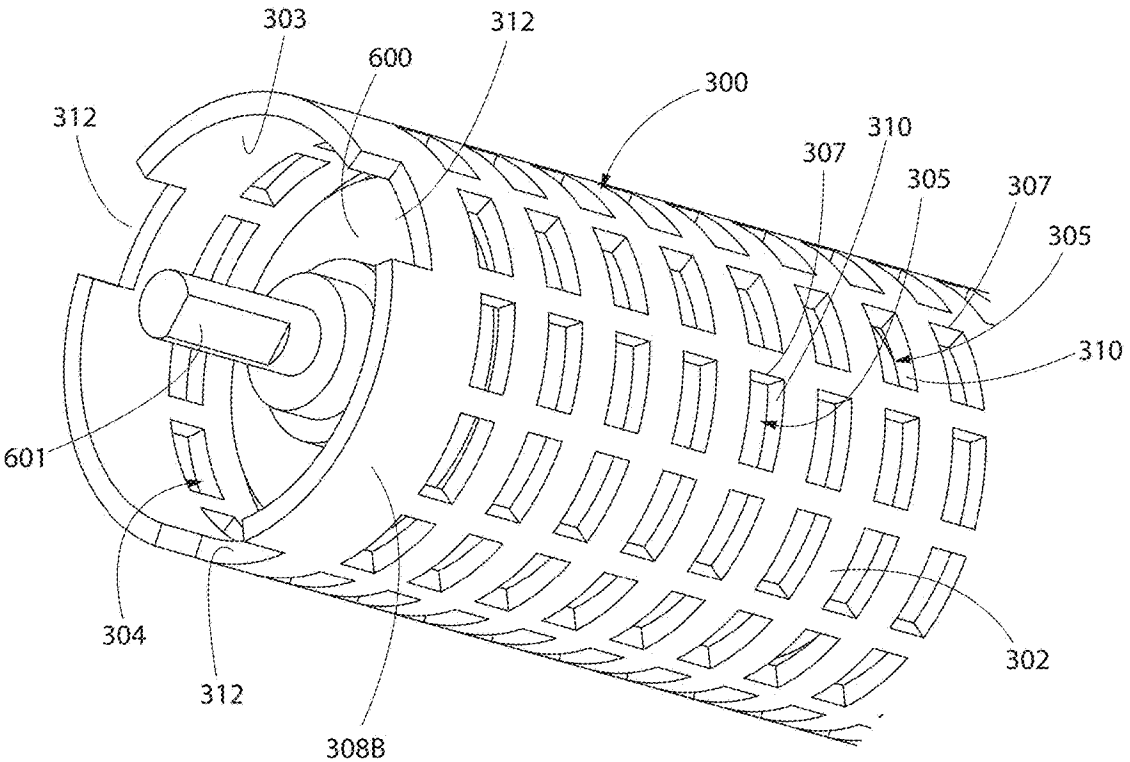
FIG. 6 is a perspective view of a second end portion of the rotary cutter of the shaving apparatus of FIG. 1, with a motor assembly is positioned therein.
Figure 7:
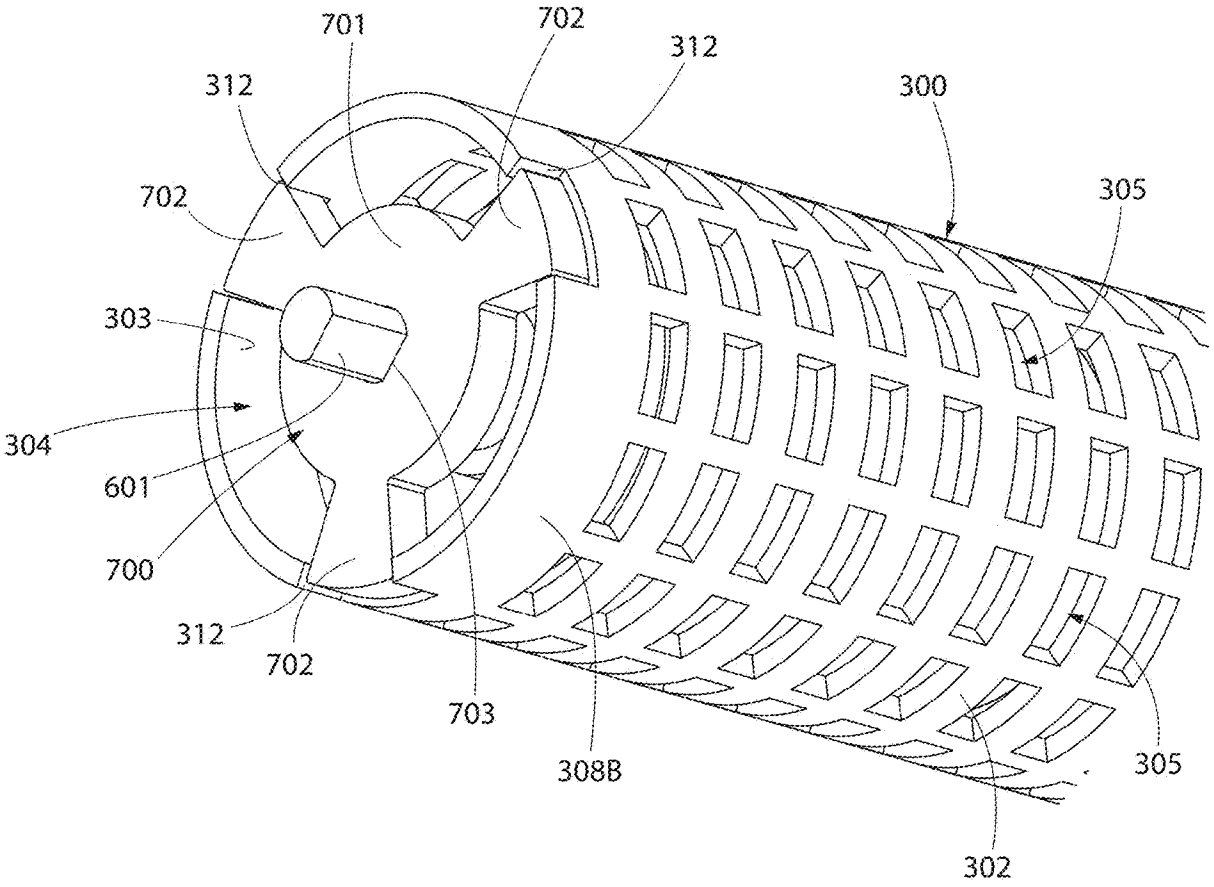
FIG. 7 is a perspective of the second end portion of the rotary cutter and the motor assembly of FIG. 6, with a coupling element coupled to an output shaft of the motor assembly.
Figure 8:
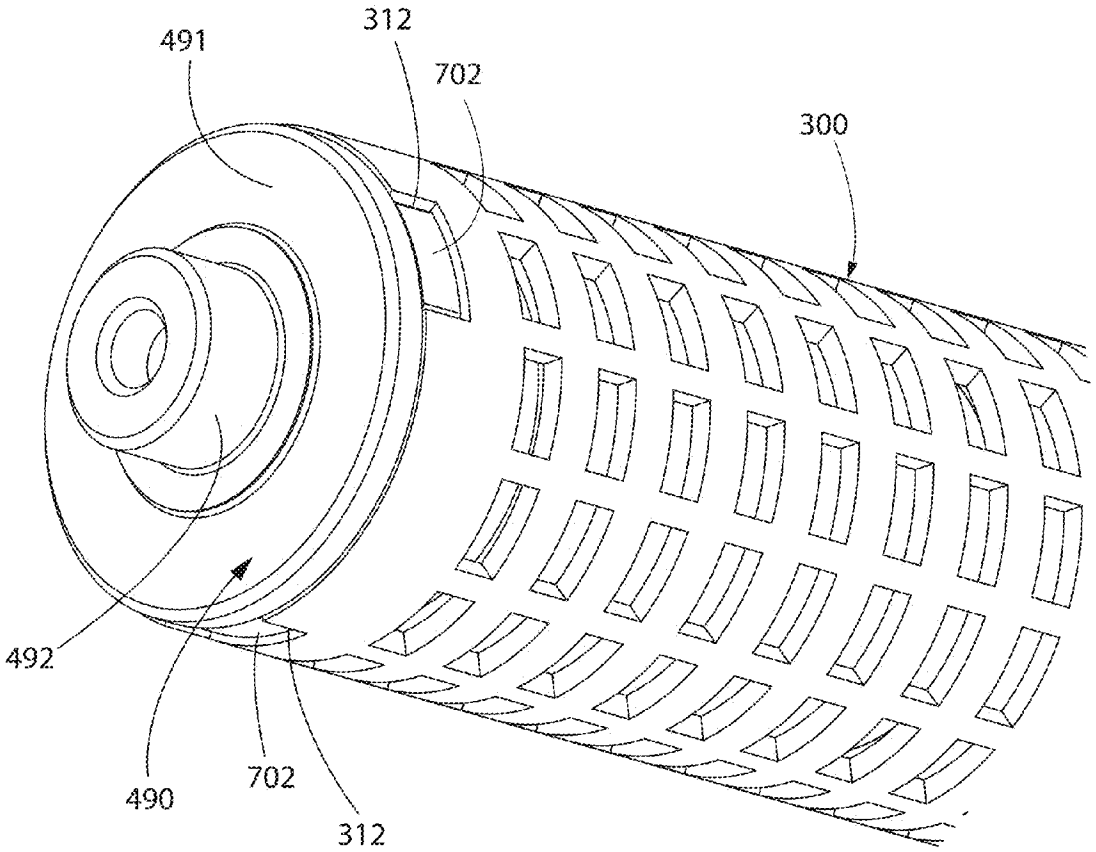
FIG. 8 is a perspective of the second end portion of the rotary cutter, the motor assembly, and the coupling element of FIG. 8, with a second rotary cutter end cap enclosing the second end portion of the rotary cutter.

Referring now to FIGS. 3-4 concurrently, the head 100 generally comprises a tubular housing 202, a fixed blade 350, the motor 400, and the rotary cutter 300, a first end cap 205, a second end cap 206, a first annular bearing 250, a second annular bearing 251, an inline drive train 600, a coupling element 700, a first rotary cutter end cap 480 and a second rotary cutter end cap 490. When the head 200 is assembled (discussed below with respect to FIG. 5), the head 200 is a compact structure, extending along longitudinal axis B-B.

The head 100 extends from a first end 207 to a second end 208 along the longitudinal axis B-B, thereby defining a maximum longitudinal width WL of the head 200. In an exemplary embodiment, the maximum longitudinal width WL of the head 200 is less than or equal to 60 mm. In another exemplary embodiment, the maximum longitudinal width WL of the head 200 is between 40 mm to 60 mm. In yet another embodiment, the maximum longitudinal width WL of the head 200 is between 45 mm to 55 mm. The head further comprises a maximum transverse width WT, extending from a lead face 209 of the head 200 to a trail face 210 of the head 200. In an exemplary embodiment, the maximum transverse width WT of the head 200 is less than or equal to 25 mm. In another embodiment, the maximum transverse width WT of the head 200 is between 10 mm to 25 mm. In yet another embodiment, the maximum transverse width WT of the head 200 is between 10 mm to 20 mm. In still another embodiment, the maximum transverse width WT of the head 200 is between 10 mm to 15 mm.

In the exemplified embodiment, both the maximum longitudinal width WL of the head 200 and the maximum transverse width WT of the head 200 are measured on the front face 204 of the head 200. The front face 204 of the head 200 is the working face of the head 200 in that it is the face of the head 200 that is put into contact with the user's skin so that the shaving apparatus 1000 can shear hairs between the rotary cutter 300 and the fixed blade 350 (as discussed in greater detail below). In alternate embodiments, the maximum longitudinal width WL of the head 200 and/or the maximum transverse width WT of the head 200 may be dictated by other components of (or at other locations on) the head 200.

The tubular housing 202 comprises an internal cavity 211 for accommodating the rotary cutter 300, the motor 400, the inline drive train 600, the first annular bearing 250, the second annular bearing 251, the coupling element 700, the first rotary cutter end cap 480 and the second rotary cutter end cap 490. The internal cavity 211 of the tubular housing 202 is dimensioned so as to be capable of receiving and enclosing the rotary aforementioned components as mentioned above (and described in greater detail below).

Figure 9A:
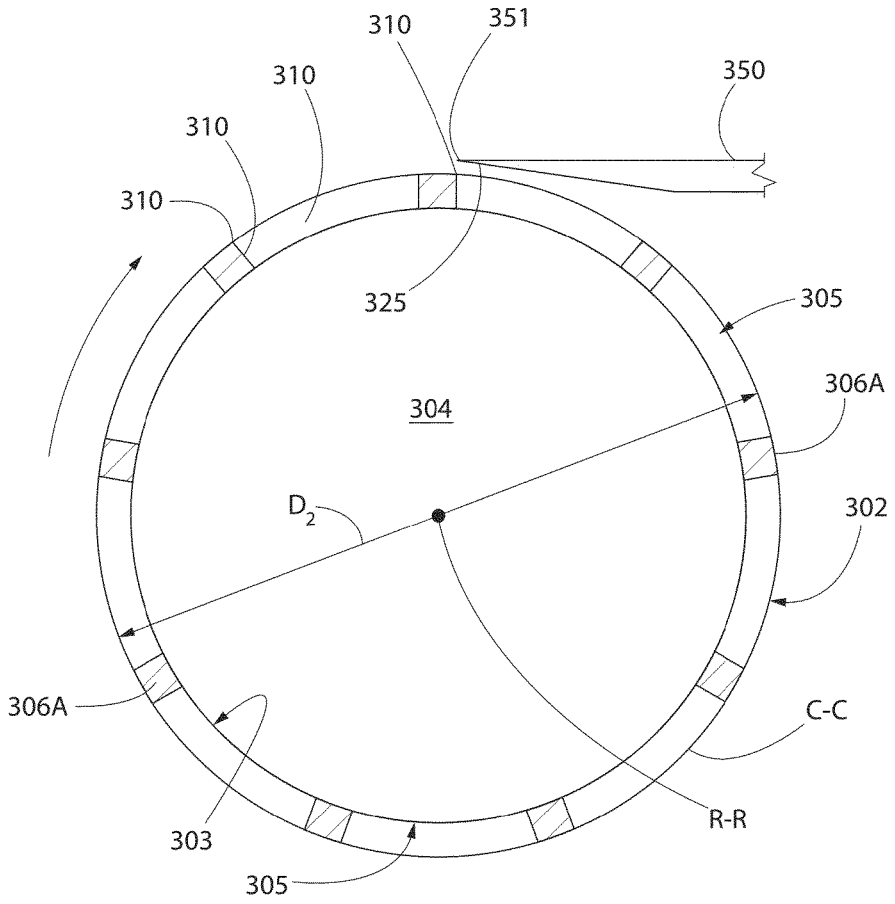
FIG. 9A is a schematic exemplifying the relative positioning and cooperation of the fixed blade and the rotary cutter of the shaving apparatus of FIG. 1.

The tubular housing 202 also comprises an elongated slot 214 that forms a passageway into the internal cavity 211 of the tubular housing 202. A portion of the rotary cutter 300 is exposed via the elongated slot 214. The elongated slot 214 allows hair bristles to enter the tubular housing 202 and be sheared between the rotary cutter 300 and the fixed blade 350 as discussed in greater detail with respect to FIGS. 9 and 9A. In the exemplified embodiment, the elongated slot 214 extends the entire longitudinal length of the tubular housing 202 in a continuous and uninterrupted manner. However, in certain alternate embodiments, the elongated slot 214 may not extend the entire longitudinal length of the tubular housing 202 and may instead be segmented and/or discontinuous in nature.

The elongated slot 214 is defined by a cutting edge 351 of the fixed blade 350 and an opposing edge 215 of the tubular housing 202. In the exemplified embodiment, the opposing edge 215 of the tubular housing 202, which is formed by a plurality of axially-spaced fingers 216 that collectively form a comb guard 217. The comb guard 217 is part of the tubular housing 202 and can be pressed against the user's skin during a cutting operation to more effectively feed the hair bristles to the rotary cutter 300 and fixed blade 350 for shearing, while at the same time protecting the user from nicking or cutting the skin. In order to further achieve this purpose, the outer surfaces of the fingers 216 of the comb guard 217 are optionally flat or rounded to facilitate the movement of the head 200 over the user's skin. In certain other embodiment, the opposing edge 215 may be a continuous edge in which the comb guard 217 is eliminated by omitting the fingers 216.

In certain embodiments, the tubular housing 202, the first end cap 205, and/or the second end cap 206 may comprise one or more openings for allowing removal of sheared hair bristle debris from the internal cavity 211 of the tubular housing 202 and/or from the central cavity 304 of the rotary cutter 300. Finally, as can be seen in FIG. 3, the fastener elements 201 are also part of the tubular housing 202. While the housing 202 of the head 200 is exemplified as being tubular in shape, the invention is not so limited in all embodiments. In certain other embodiments, the housing 202 may take on other structural arrangements and shapes.

Referring now to FIGS. 4, 5, 9 and 9A, the rotary cutter 300 is of a hollow cylindrical configuration. The rotary cutter 300 comprises a hollow cutter tube 301 having an outer surface 302 and an inner surface 303. The rotary cutter 300 comprises a central cavity 304 which, in the exemplified embodiment, is formed by the inner surface 303 of the cutter tube 301 about a central axis, which is also the rotary axis R-R of the rotary cutter 300. The internal cavity 304 of the rotary cutter 300 is dimensioned to receive the motor 400 and the inline drive train 600.

The rotary cutter 300 further comprises a plurality of apertures 305 formed in the outer surface 302 of the cutter tube 301. The outer surface 302 of the cutter tube 301 define a reference cylinder (delineated by circle C-C of FIG. 9A) that is concentric to the rotational axis R-R of the rotary cutter 300 and has a diameter D2. In an exemplary embodiment, the diameter D2 is less than or equal to 20 mm. In another embodiment, the diameter D2 is between 6 mm to 20 mm.

Each of the apertures 305 is defined by a cutting edge 307 having a closed-geometry. The cutting edges 307 of the cutting tube 301, in certain embodiments, may be formed by the intersection of the outer surface 302 of the cutter tube 301 and the radial walls 310 that circumscribe the apertures 305. The cutting edges 307, in certain embodiments, may lie either substantially flush with the outer surface 302 of the cutter tube 301 or between the outer and inner surfaces 302, 303 of the cutter tube 301. In certain embodiments, the cutter tube 301 may also comprises one or more apertures 305 defined by cutting edges 307 that have an open geometry, such as those that may be located near the edges of the cutter tube 301 (not illustrated).

When the rotary cutter 300 is mounted within the head 200 and rotated by the motor 400, the user's hairs extend into the apertures 305 and are sheared between the cutting edges 307 and the cutting edge 351 of the fixed blade 350 during a shaving operation. As discussed below in greater detail with reference to FIGS. 10 to 18, each of the plurality of apertures 305 can be considered to have a shearing portion 330 and a non-shearing portion 331.

The use of apertures 305 to form the cutting edges 307 of the rotary cutter 300, as opposed to protruding elongated ridges, may increase the safety of the shaving apparatus 1000. Utilizing apertures 305 to form the cutting edges 307 add the element of safety by keeping the skin almost completely out of the reference circle C-C (see FIG. 9A) of the rotary cutter 300, thereby reducing the chance of a skin-fold being caught and nicked.

In the exemplified embodiment, each of the apertures 305 extend through the cutter tube 301 from the outer surface 302 to the inner surface 303, thereby forming a plurality of radial passageways through the cutter tube 301. In certain other embodiments, however, the apertures 305 may be in the form of depressions in the outer surface 302 that do not go through the entire thickness of the cutter tube 301 such that the apertures 305 are "blind."

The cutter tube 301, as exemplified, comprises a lattice structure 306 that defines the apertures 305. The lattice structure 306 comprises a plurality of axial members 306A and a plurality of circumferential members 306B that are arranged in an intersecting manner. In the exemplified embodiment, the plurality of axial members 306A extend substantially parallel to a reference line on the outer surface 302 of the cutter tube 301 that is parallel to the rotational axis R-R while the plurality of circumferential members 306B extend substantially perpendicular to such a reference line. In other embodiments, however, the plurality of axial members 306A may be inclined relative to such a reference line and, thus, have a circumferential component of extension. Similarly, in certain embodiments, however, the plurality of circumferential members 306B may be inclined relative to such a reference line and, thus, have an axial component of extension. In such instances, such members of the lattice structure 306 may be categorized as "circumferential" or "axial" based on its primary component of extension. For those members arranged at a 45°, the member can be categorized as either "circumferential" or "axial."

Figure 22:
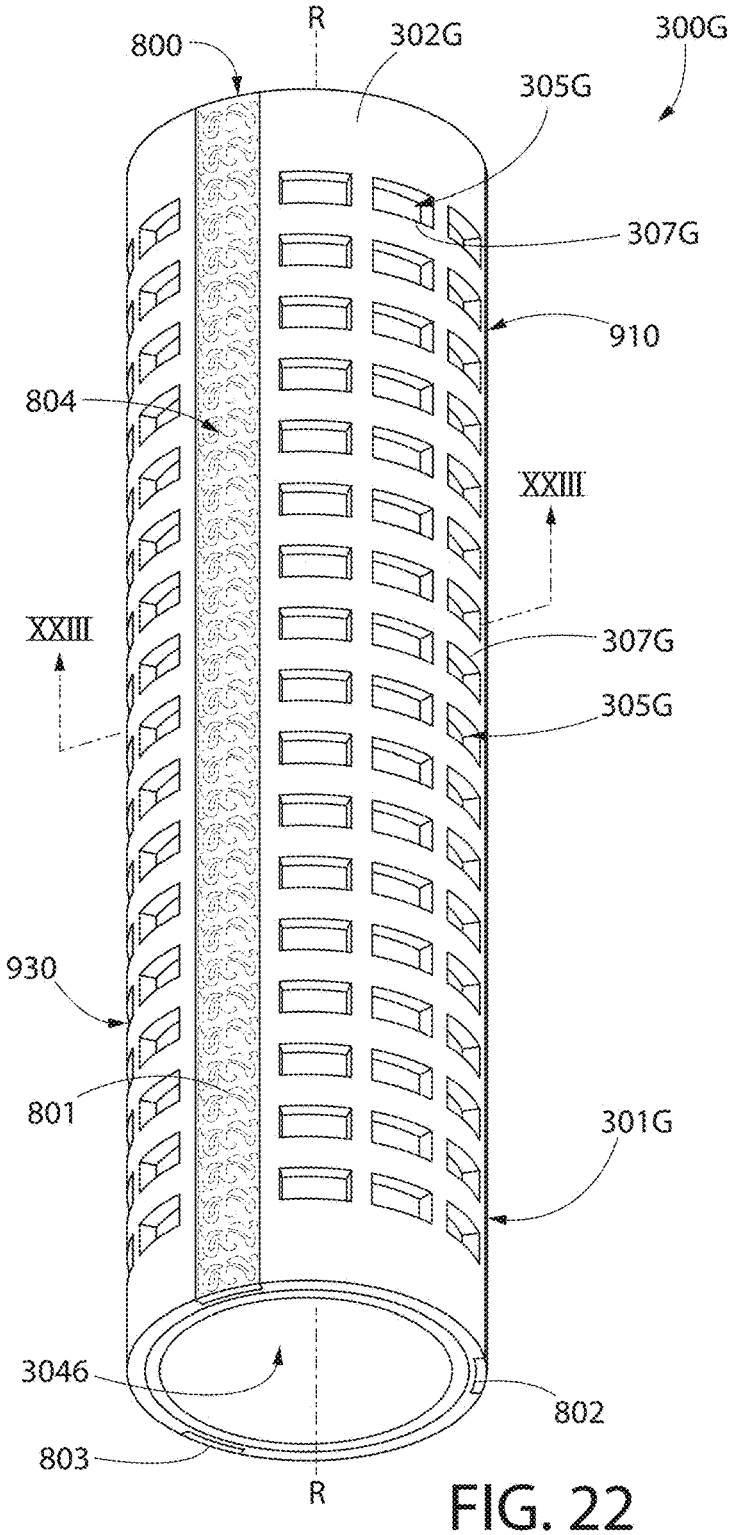
FIG. 22 is a perspective of a rotary cutter having a lubricating element coupled thereto that can be used with the shaving apparatus of FIG. 1 according to the present invention.

In the exemplified embodiment, the lattice structure 306 covers the entire circumference of the cutter tube 301 in a continuous manner, with the exception of the axial end portions 308A, 308B, which are free of the apertures 305. In certain other embodiments, the lattice structure 308 may be segmented and separated by portions of the cutter tube 301 that are free of the apertures 305 (such as that which is shown in FIG. 22 where these portions that are free of the apertures 305 are used to accommodate a lubricating element).

In the exemplified embodiment, the apertures 305 are rectangular in shape. In other embodiments, the apertures 305 may be round, triangular square, elongated oval, pentagonal, hexagonal, or other polygonal or irregular shapes that have a closed-geometry. All of the apertures 305 in the exemplified embodiment are the same size and shape. In other embodiments, however, the apertures 305 may comprise apertures of a plurality shapes and/or sizes that are different from one another. In a certain embodiment, each of the apertures 305 are preferably sized and shaped so as to be capable of accommodating at least one hair of the user, which may have a diameter in a range of 15 to 180 microns.

Figure 10:
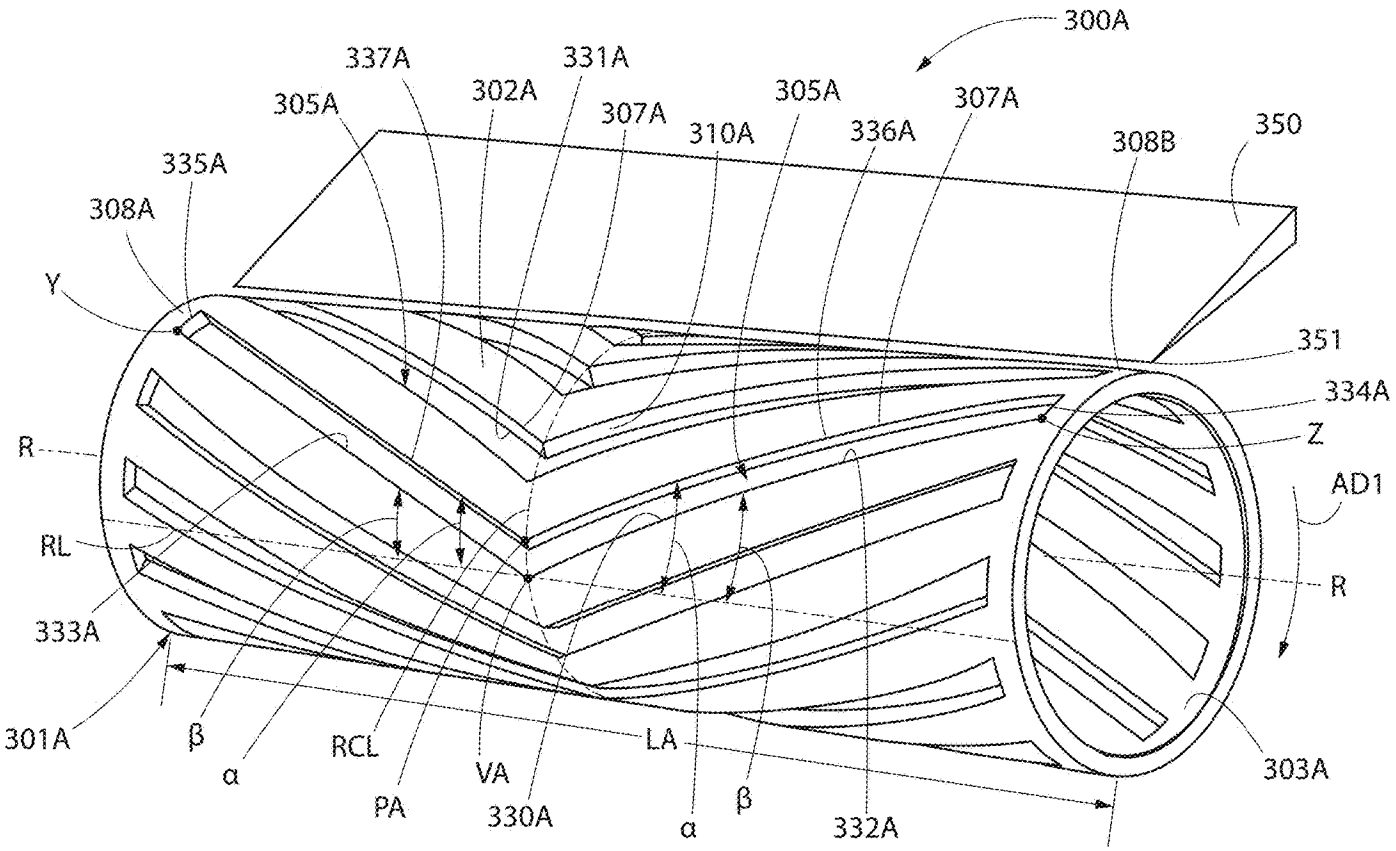
FIG. 10 is a perspective view of a rotary cutter having has a first alternative pattern of apertures that can be used with the shaving apparatus of FIG. 1.
Figure 11:
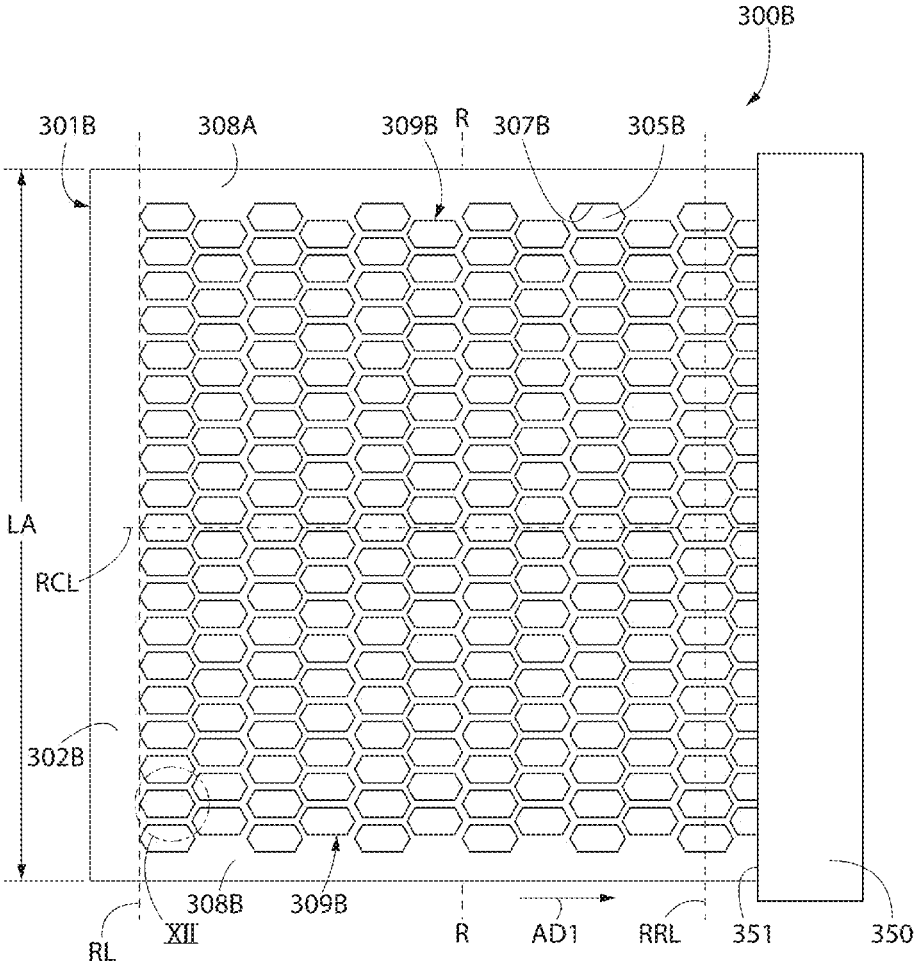
FIG. 11 is a two-dimensional plan view of a rotary cutter having a second alternative pattern of apertures that can be used with the shaving apparatus of FIG. 1.

The apertures 305, in the exemplified embodiment, are elongated such that they comprise a major axis A1 and a minor axis A2. The major axis A1 is longer than the minor axis A2. In certain embodiments, a ratio of A1/A2 may be in a range of 10:1 to 2:1. The major axis A1 of the apertures 305 extend in the circumferential direction while the minor axis extends in the axial direction. As a result, each of the apertures 305 can be considered circumferentially elongated. In certain other embodiments, such as that which is shown in FIGS. 10 and 11, the apertures 305 may be axially elongated. In these and other such embodiments, the major axis A1 will extend in the axial direction while the minor axis extends in the circumferential direction.

In certain embodiments, the apertures 305 define such a large cumulative surface area (compared to the overall surface area of the outer surface 302) of the cutter tube 301 that the cutter tube 301 can be considered a tubular screen. In one embodiment, the apertures 305 may have a cumulative surface area that is greater than or equal 0.5 of a total surface area of the outer surface 302 of the cutter tube 301. In another embodiment, the apertures 305 have a cumulative surface area that is greater than or equal 0.6 of a total surface area of the outer surface 302 of the cutter tube 301. In yet another embodiment, the apertures 305 may have a cumulative surface area that is greater than or equal 0.75 of a total surface area of the outer surface 302 of the cutter tube 301. In still another embodiment, the apertures 305 have a cumulative surface area that is greater than or equal 0.8 of a total surface area of the outer surface 302 of the cutter tube 301.

In the exemplified embodiment, the apertures 305 are provided in a pattern comprising a plurality of rows 309 of the apertures 305. The rows 309, in the exemplified embodiment are axial rows that extend substantially parallel to the rotational axis R-R of the rotary cutter 300. In certain other embodiments, the rows 309 may be inclined relative to the rotational axis R-R so as to form a partial helix about the outer surface 302 of the cutter tube 301. The apertures 305 can be created in a wide range of shapes and sizes, and can be applied to the cutter tube 301 in a wide range of patterns. Some of these alternatives will be discussed in greater detail with respect to FIGS. 10 to 18. Moreover, as discussed in greater detail with respect to FIGS. 13 to 18, the shape, size and pattern of the apertures 305 may be selected so that the number of hairs being sheared between the cutting edges 307 of the rotary cutter 300 and the cutting edge 351 of the fixed blade 350 is precisely controlled to achieve, for example, goals such as low torque requirements for the motor 400 and a balance of force to which the rotary cutter 300 is subjected.

The cutter tube 301 may have a thickness in a range of 0.1 mm to 2.5 mm in certain embodiments. The cutter tube 301 may be formed of a metal or other suitable material. The cutter tube 301, in one embodiment, the cutter tube 301 is formed from a sheet metal that is rolled into shape and in which the edges are connected together. The apertures 305 may be formed in the sheet metal either prior to or after rolling to form the cutter tube 301 using processes, such as laser cutting, punching, chemical etching, or combinations thereof. In one specific embodiment, laser cutting may be preferred in that laser cutting may not create residual stresses in the processed sheet metal. Thus, the laser cut sheet metal that forms the cutter tube 301 will retain its desired shape with no deformation. In other embodiments, the cutter tube 301 can be formed by other materials and other techniques, including machining, injection molding, casting, and combinations thereof with appropriate materials. In one embodiment, stock tube may be used in which the apertures 305 are formed, such as by laser cutting.

In one embodiment, the outer surface 302 of the cutter tube 301 can have a polished finish. The outer surface 302 may also have a low fiction coating and/or high strength coating applied thereto.

Referring now to FIGS. 3-4 and 6-9A, the assembly of the head 200, including certain components and the structural cooperation there between, will now be described. When the head 200 is assembled for operation, the fixed blade 350 is mounted adjacent the rotary cutter 300. In one embodiment, the fixed blade 350 is mounted adjacent the rotary cutter 300 so that the cutting edge 351 of the fixed blade 350 extends substantially parallel to the axis of rotation R-R of the rotary cutter 300 (which in the exemplified embodiment is coincident with the longitudinal axis B-B of the head 200). In the exemplified embodiment, such adjacent positioning is achieved by mounting the fixed blade 350 to the tubular housing 202 so that the cutting edge 351 of the fixed blade 350 extends into the slot 314 and is adjacent the outer surface 302 (which includes the cutting edges 307) of the cutter tube 301 of the rotary cutter 300.

In one embodiment, the fixed blade 350 is "fixed" with respect to its radial distance from the axis of rotation B-B of the rotary cutter 300. As used herein, the term "fixed" is intended to cover embodiments where small vibrations may be imparted to the fixed blade 350 and/or wherein the fixed blade 350 may axially translate slightly in a manner that maintains the cutting edge 351 substantially parallel to axis of rotation B-B and its radial distance therefrom. In certain other embodiments, the fixed blade 350 may be completely stationary and immovable with respect to both the axis of rotation R-R and the tubular housing 202.

The cutting edge 351 of the fixed blade 350 may extends along the entire length of the rotary cutter 300 in certain embodiments. The cutting edge 351 of the fixed blade 350 is sufficiently proximate the cutting edges 307 of the rotary cutter 300 so as to be effective in cooperating with the cutting edges 307 of the cutter tube 301 to shear hair bristles there between during a cutting operation when the motor 400 is activated and the front face 204 of the head 200 is pressed against and moved along the skin. In one embodiment, a tolerance, in the form of a cutting gap 325 is designed to exist between the cutting edge 351 of the fixed blade 350 and the cutting edges 307 of the cutter tube 301 of the rotary cutter 300 during a cutting operation.

When the head 200 is assembled for use, the motor 400 is positioned in the central cavity 304 of the rotary cutter 300 and operably coupled thereto so as to be capable of rotating the rotary cutter 300 about the rotational axis R-R. According to some embodiments of the present invention, the motor 400 is an electric motor and is electrically coupled to the power source 105 housed in the handle 100 as described above. The motor 400 can be powered by alternating or direct current. In certain embodiments, the motor 400 may be a brushless type motor or a brushed motor type; and/or may be a cored or coreless type motor. For example, a brushless DC electric motor is a synchronous electric motor which is powered by direct-current electricity and has an electronically controlled commutation system (a "controller") instead of a mechanical commutation system based on brushes, as present in the brushed motors. It is noted herein that the term "motor" is intended to encompass the assembly of parts which transform electrical power to mechanical motion as a required output force/torque and speed.

The inline drive train 600, which may be omitted in certain embodiments, can be provided to control the output speed and torque of the electric motor 400. The inline drive train 600 is a drive transmission device, such as a gear box, which is placed inline with the motor 400, namely the drive shaft 401 of the motor 400. The output shaft 601 of inline drive train 600 may share the same axis of rotation. The inline drive train 600 may include be epicyclic gearing, or planetary gearing. Such an inline gearing system can be selected so as to increase the torque of the motor and reduce its speed or the opposite, depending on the selected motor and desired terminal rotation output.

The coupling element 700 is coupled (directly or indirectly) to the electric motor 400 and to the cutter tube 301 of the rotary cutter 300 so that rotational output of the electric motor 400 is transmitted to the cutter tube 301 of the rotary cutter 300 by the coupling element 700. In the exemplified embodiment, the coupling element 700 is coupled to the output shaft 601 of the inline drive train 600 (which in turn is operably coupled to the motor 400) and the end portion 308B of the cutter tube 301 of the rotary cutter 300. In certain other embodiments, the coupling element 700 may be coupled to the electric motor 400 directly (for example, through the drive shaft 401 or other rotating output). In still other embodiments, additional intervening drive transmission devices may be utilized.

The coupling element 700 is non-rotatable relative to the rotary cutter 300. Moreover, the coupling element 700 engages the cutter tube 301 of the rotary cutter 300 such that the coupling element 700 does not exert radial force (such as an outward radial force) on the cutter tube 301. The exertion of a radial force on the cutter tube 601 may result in deformation (even slight) of the cutter tube 301. Even slight deformation can result in an unbalanced cutter tube 301 during fast rotation, which may cause uneven contact with the skin and the fixed blade 350 during the shaving process. The coupling element 700 provides a structure that transmits the rotational output of the motor 400 to the rotary cutter 300 without the potential for deformation as no radial forces are exerted on the cutter tube 301 during the engagement process or during rotation of the rotary cutter 300 by the motor 400.

The coupling element 700, in the exemplified embodiment, comprises a hub component 701 and a plurality of spoke components 702 radially extending from the hub component 701. The spoke components 702 are arranged about the hub component 701 in a circumferentially equispaced manner. Each of the spoke components 702 has a circumferential width that increases with distance from the hub component 701. While three spoke components 702 are exemplified, any number of spoke components 702 can be utilized in other embodiments, including one. Moreover, each of the spoke components 702 can have a constant circumferential width or can be in the form of a simple protuberance.

The hub component 701 comprises a central aperture 703 that receives the output shaft 601 of the inline drive train 600. The central aperture 703 of the hub component 701 is non-circular, as is the output shaft 601, so that the output shaft 601 can engage and rotate the coupling element 700. The spoke components 702 of the coupling element 700 are coupled to the cutter tube 301. The cutter tube 301 comprises a plurality of features 312, which are in the form of slots formed into the edge of the cutter tube 301 in the exemplified embodiment, that mate with the spoke components 702 of the coupling element 700. Each of the spoke components 702 mate with one of the features 312. Each of the slots have a circumferential width that increases with distance from the rotational axis R-R and corresponds to the circumferential width of the spoke component 702 that mates with it. While the features 312 of the cutter tube 301 that mate with the spoke components 702 are exemplified as slots, in certain other embodiments the features may comprise inboard apertures, collars that engage the spoke components 702, or protuberant structures that engage the spoke components 702.

The coupling element 700 may, in certain embodiments, decouple the concentricity requirements of the assembly. The axis of rotation R-R of the cutter tube 301 and the rotational axis of the output shaft 601 of the inline drive train 600 may be slightly decoupled (i.e., non-concentric) in certain instances. The rotational motion that is transferred via the coupling element 700 does not depend or require complete concentricity between the cutter tube 301 and the output shaft 601. In other words, the rotational axis can be slightly misaligned with the rotational axis R-R, thereby simplifying the manufacturing and assembly and providing a robust solution.

Once the motor 400, the inline drive train 600, and coupling element 700 are assembled, the first and second rotary cutter end caps 480, 490 are coupled thereto. The first rotary cutter end cap 480 fits within a first end of the cutter tube 301 and comprises an annular body 481 and a hollow post 482. An axial passageway is formed through the first rotary cutter end cap 480 so that electrical connectors 501A, 501B which, in the exemplified embodiment are wires, can pass therethrough to couple to the contacts 402 of the motor 400. The first rotary cutter end cap 480 is non-rotatably coupled to the motor 400 and does not rotate about the rotational axis R-R during operation. The first annular bearing 250 is slid over the hollow post 482 of the first rotary cutter end cap 480 and into the internal cavity 304 of the rotary cutter 300. The outer surface of the first annular bearing 250 engages the inner surface 303 of the cutter tube 301 and the inner surface of the first annular bearing 250 engages the hollow post 482 of the first rotary cutter end cap 480. As such, the outer portion of the first annular bearing 250 can rotate relative to the inner portion of the first annular bearing 250.

The second rotary cutter end cap 490 fits within a second end of the cutter tube 301 and comprises an annular body 491 and a hollow post 492. The second rotary cutter end cap 490 receives and engages the output shaft 601 of the inline drive train 600 and engages the coupling element 700. The second rotary cutter end cap 490 rotates with the rotary cutter 300, the coupling element 700, and the output shaft 601 of the inline drive train 600 about the rotational axis R-R. The second annular bearing 251 is slid over the hollow post 492 of the second rotary cutter end cap 490 but remains outside of the cutter tube 301. The inner surface of the second annular bearing 251 engages the hollow post 492 of the second rotary cutter end cap 490.

The aforementioned assembly is then mounted within the internal cavity 211 of the housing 202. Specifically, the hollow post 482 of the first rotary cutter end cap 480 engages the first end cap 205 so as to be non-rotatable relative thereto. The outer surface of the second annular bearing 251 is likewise engaged to the second end cap 206 so as to be non-rotatable relative thereto. However, rotation of the rotary cutter 300 by the motor 400 is possible due to the afforded free rotation of the inner portion of the second annular bearing 251 and the outer portion of the first annular bearing 250.

In the exemplified embodiment, both of the annular bearings 250, 252 are of the ball-bearing type. However, bearing types that can be used in the context of the present invention include, without limitation, plain bearings, also known as sliding or slipping bearings which are based on rubbing surfaces and typically a lubricant (implemented by use of hard metals or plastics such as PTFE which has coefficient of friction of about 0.05); rolling element bearing, also known as ball bearings which are based on balls or rollers (cylinders) and restriction rings; or magnetic bearings and flexure bearings. The term "annular" may include segmentally annular in certain embodiments.

It is to be understood that various parts of the internally motorized shaving head presented herein are presented as discrete and separate parts for the sake of clarity and definition. However, some of the parts described herein can be manufactured as a union with other parts, forming a single continuous unit, while some parts described herein as single continuous units can be formed by a plurality of sub-parts.

Referring now to FIGS. 10-18, a plurality of rotary cutters 300A-E having alternate patterns of apertures 305A-E are illustrated. The rotary cutters 300A-E can be used in place of the rotary cutter 300 of FIGS. 1-9, as described above. With the exception of the size, shape and pattern of the apertures 305A-E, the rotary cutters 300A-E may be identical to the rotary cutter 300. Thus, the discussion of the rotary cutters 300A-E below will be limited to these new features, with the understanding that the discussion above relating to the rotary cutter 300 is applicable to each exemplary embodiment. Therefore, like reference numbers will be used to identify like elements with the addition of the appropriate alphabetical suffix "A-E." Furthermore, additional details of the apertures 305A-E will be discussed below along with the creation of aperture patterns and aperture shapes that may achieve certain benefits of operation and performance of the shaving apparatus 1000. Finally, it should be noted that the rotary cutters 305B-E are shown in a simplified 2D schematic form for simplicity of discussion with the understanding that the rotary cutters 305B-E take the form of a 3D cylinder or tube when utilized in the shaving apparatus 1000.

Turning first to FIG. 10, a rotary cutter 300A is exemplified that comprises a cutter tube 301A including apertures 307A arranged in a first alternate pattern. The cutter tube 301A comprises a plurality of axially elongated apertures 305A, which are in the form of a V-shape. Each of the apertures 305A extends from the first axial end portion 308A (that is free of apertures) to the second axial end portions 308B (that is also free of apertures). Each of the apertures 305A is defined by a cutting edge 307A that defines a closed-geometry. Each of the cutting edges 307A comprises a shearing portion 330A and a non-shearing portion 331A. In the exemplified embodiment in which the rotary cutter 300A is rotated about the rotational axis R-R in the angular direction AD1, the shearing portion 330A extends from point Y to point Z and includes the valley apex VA while the non-shearing portion 331A extend from point Z to point Y and includes the peak apex PA.

As used herein, the "shearing portions" of the cutting edges defined by the apertures of the rotary cutter are those portions of the cutting edges of the rotary cutter that are capable of contacting and shearing hairs, in cooperation with the cutting edge of the fixed blade, during rotation of the rotary cutter during the shaving process. On the other hand, as used herein, the "non-shearing portions" of the cutting edges defined by the apertures of the rotary cutter are those portions of the cutting edges of the rotary cutter that are incapable of contacting and shearing hairs, in cooperation with the cutting edge of the fixed blade, during rotation of the rotary cutter during the shaving process. It is to be understood that for any given aperture, the portion of the cutting edge that can be considered the "shearing portion" and the portion of the cutting edge that can be considered the "non-shearing portion" is dependent on the angular direction of rotation of the rotary cutter about the rotational axis. Thus, a portion of the cutting edge of an aperture may be considered the "shearing portion" when the rotary cutter is rotated about the rotational axis in a first angular direction while this same portion of the cutting edge of the aperture may be considered the "non-shearing portion" when the rotary cutter is rotated about the rotational axis in a second angular direction (opposite the first angular direction).

Turning back to the embodiment of FIG. 10, for each of the apertures 305A, the shearing portion 330A comprises a first inclined section 332A and a second inclined section 333A that converge to form the valley apex VA. Each of the first and second inclined sections 332A, 333A form an acute angle β with a reference line RL on the outer surface 302A of the cutter tube 301A (which is also the outer surface of the rotary cutter 300A) that is parallel to the rotational axis R-R. For each of the apertures 305A, the non-shearing portion 331A comprises a first circumferential section 334A and a second circumferential section 335A, wherein each of the first and second circumferential sections 334A, 335A are orthogonal to the reference line RL. The non-shearing portion also comprises a first inclined section 336A and a second inclined section 337A that converge to form the peak apex PA. Each of the first and second inclined sections 336A, 337A form an acute angle α with the reference line RL. In the exemplified embodiment, the acute angle α is substantially equal to the acute angle β. In certain other embodiments, the acute angle α is different than the acute angle β. The acute angles β and α may be between 10° to 60° in certain embodiments.

For each of the apertures 305A, the valley apex VA and the peak apex PA of the cutting edge 307A are located at the center of the axial length LA of the cutter tube 301A, which is delineated with reference centerline RCL. Additionally, the pattern of the apertures 305A is symmetric about the reference centerline RCL. More specifically, the portion of the pattern on one side of the reference centerline RCL is a mirror image of the portion of the pattern on the opposite side of the reference centerline RCL. Finally, while in the exemplified embodiment of FIG. 10 each of the apertures 305A is comprises two oppositely inclined "legs" so as to form a V-shaped aperture, in other embodiments, more than two oppositely inclined "legs" can be included in succession to form an axially elongated undulating aperture.

Figure 12:
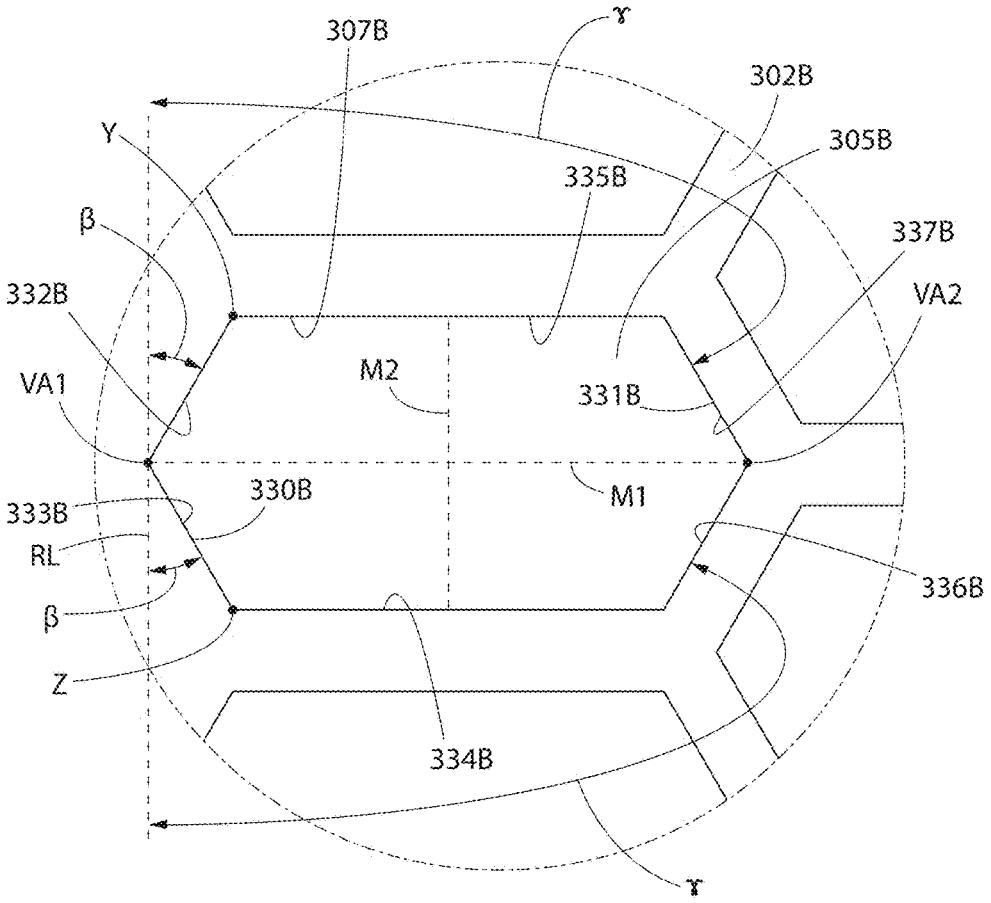
FIG. 12 is a close-up view of area XII of FIG. 11.

Referring now to FIGS. 11-12 concurrently, a rotary cutter 300B is exemplified that comprises a cutter tube 301B including apertures 307B arranged in a second alternate pattern. In the second alternate pattern, the apertures 305B are arranged in a plurality of rows 309B. As exemplified, the plurality of rows 309B are oriented such that a reference row line RRL connecting the centers of the apertures 305B in any given row 309B is parallel to the rotational axis R-R. Thus, the plurality of rows 309B in the exemplified embodiment can be considered axial rows. In other embodiments (such as the one shown in FIG. 17), the plurality of rows 309B can be oriented such that the reference row line RRL is at an acute angle (or otherwise inclined) relative to rotational axis R-R.

Each of the apertures 305B has a hexagonal shape. In the exemplified embodiment, each of the apertures 305B is also circumferentially elongated such that aperture 305B comprises a major axis M1 and a minor axis M2 wherein M1 is longer than M2. The major axis M1 is substantially perpendicular to a reference line RL on the outer surface 302B of the cutter tube 301B (which is also the outer surface of the rotary cutter 300B) that is parallel to the rotational axis R-R while the minor axis M2 is substantially perpendicular to the reference line RL. In other embodiments, the apertures 305B may be axially elongated such that M2 is greater than M1.

Each of the apertures 305B is defined by a cutting edge 307B that defines a closed-geometry. Each of the cutting edges 307B comprises a shearing portion 330B and a non-shearing portion 331B. In the exemplified embodiment in which the rotary cutter 300B is rotated about the rotational axis R-R in the angular direction AD1, the shearing portion 330B extends from point Y to point Z and includes the first valley apex VA1 while the non-shearing portion 331B extend from point Z to point Y and includes the second valley apex VA2.

In the exemplified embodiment, for each of the apertures 305B, the shearing portion 330B comprises a first inclined section 332B and a second inclined section 333B that converge to form the first valley apex VA1. Each of the first and second inclined sections 332B, 333B form an acute angle β with the reference line RL. For each of the apertures 305B, the non-shearing portion 331B comprises a first circumferential section 334B and a second circumferential section 335B, wherein each of the first and second circumferential sections 334B, 335B are orthogonal to the reference line RL. The non-shearing portion 331B also comprises a first inclined section 336B and a second inclined section 337B that converge to form the second valley apex VA2. Each of the first and second inclined sections 336B, 337B form an obtuse angle γ with the reference line RL. In the exemplified embodiment, the obtuse angle γ and the acute angle β are supplementary to one another. In certain other embodiments, the obtuse angle γ and the acute angle β may not be supplementary. The acute angle β may be between 10° to 60° in certain embodiments while the obtuse angle γ may be between 90° to 150° in certain embodiments.

As a final note, the pattern of the apertures 305B is symmetric about the reference centerline RCL (which divides the axial length LA of the rotary cutter 300B in half). In this specific embodiment, the portion of the pattern on one side of the reference centerline RCL is a mirror image of the portion of the pattern on the opposite side of the reference centerline RCL.

Figure 13:
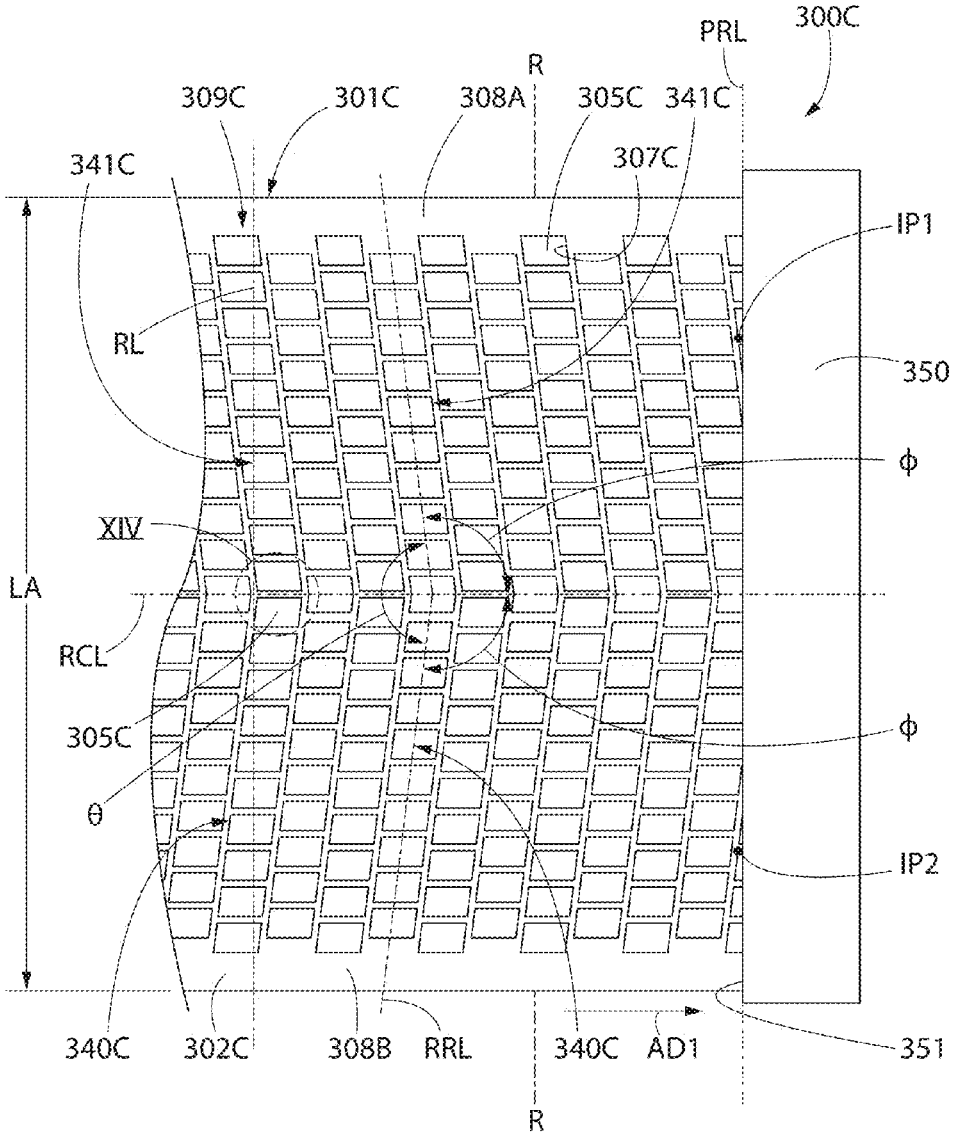
FIG. 13 is a schematic illustrating how the cutting edges of a rotary cutter having a third alternative pattern of apertures interact with a fixed blade when utilized in the shaving apparatus of FIG. 1.
Figure 14:
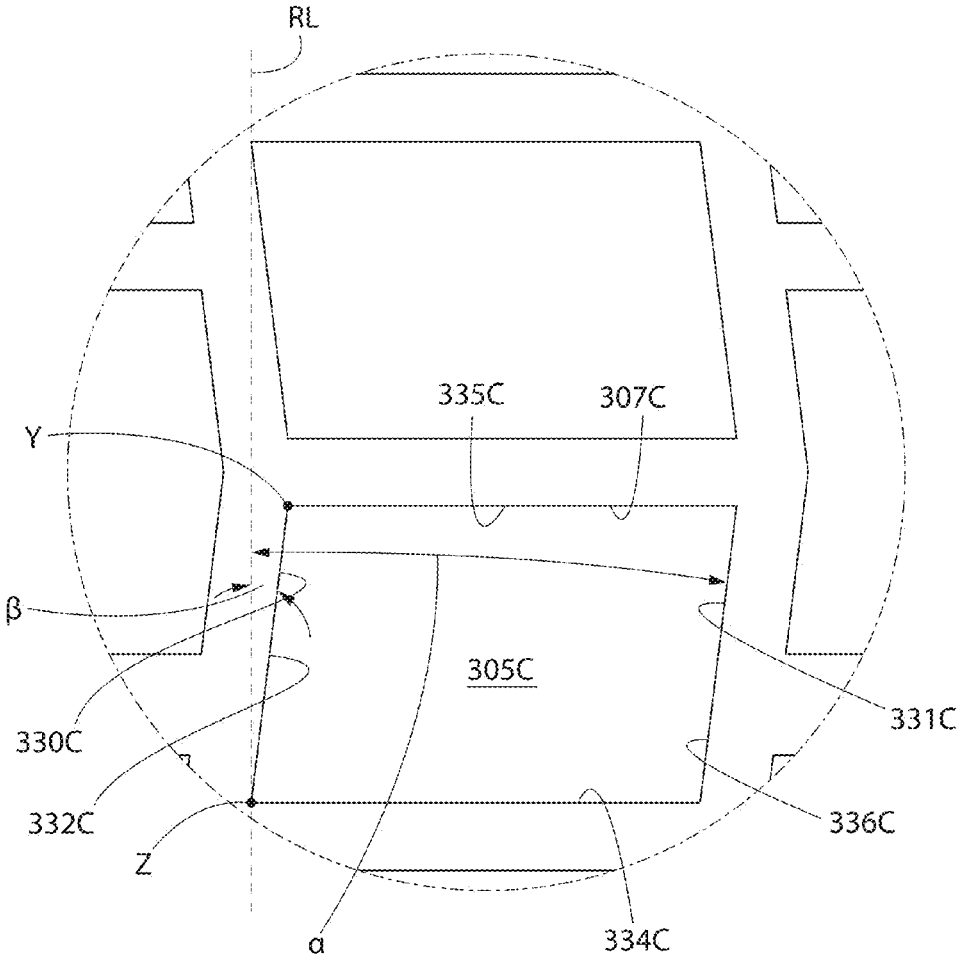
FIG. 14 is a close-up view of area XIV of FIG. 13.

Referring now to FIGS. 13-14, a rotary cutter 300C is exemplified that comprises a cutter tube 301C including apertures 307C arranged in a third alternate pattern. The third alternate pattern of the apertures 307C is specifically designed so that the so that only a selected number of shearing portions 330C of the cutting edges 307C of the apertures 305C are capable of actively shearing hairs with the fixed blade 350 at any given point in time. Moreover, the third alternate pattern of the apertures 307C is specifically designed so that the rotary cutter 300C may be subjected to a substantially balanced load that results from the reactionary forces imparted on the rotary cutter 300C by the hairs during the shearing process that takes place with the cutting edge 351 of the fixed blade 350 during a shaving process. As a result, the torque requirements of the motor 400 can be optimized and the rotary cutter 300C may more accurately maintain its proper shape and spacing with the fixed blade 350.

In the third alternate pattern, the apertures 305C are arranged in a plurality of rows 309C. The apertures 305C of each of the rows 309C are arranged so that their centers are located along a reference row line RRL. Each of the rows 309C comprise a first row section 340C located on one side of the reference centerline RCL (which divides the axial length LA of the rotary cutter 300C in half) and a second row section 340C located on an opposite side of the reference centerline RCL. The first and second row sections 340C, 341C collectively form the row 309C. The portion of the reference row line RRL that extends along the first row portion 340C and the portion of reference row line RRL that extends along the first row portion 340C intersect at the reference centerline RCL to form an angle θ that is less than 180°. Moreover, the portion of the reference row line RRL that extends along the first row portion 340C and the portion of the reference row line RRL that extends along the first row portion 340C each form an obtuse angle ϕ with the reference centerline RCL. The two obtuse angles ϕ and the angle θ collectively add up to 360°. The pattern of the apertures 305C is symmetric about the reference centerline RCL (which divides the axial length LA of the rotary cutter 300C in half). In this specific embodiment, the portion of the pattern on one side of the reference centerline RCL is a mirror image of the portion of the pattern on the opposite side of the reference centerline RCL.

Each of the apertures 305C is defined by a cutting edge 307C that defines a closed-geometry. Each of the cutting edges 307C comprises a shearing portion 330C and a non-shearing portion 331C. The apertures 305C that are not intersected by the reference centerline RCL have a rhombus shape while the apertures 305C that are intersected by the reference centerline RCL have a chevron shape. In the exemplified embodiment in which the rotary cutter 300C is rotated about the rotational axis R-R in the angular direction AD1, the cutting edge 307C of each of the rhombus shaped apertures 305C has a shearing portion 330C extends from point Y to point Z (moving counterclockwise about the cutting edge 307C in FIG. 14) while the non-shearing portion 331C extends from point Z to point Y (also moving counterclockwise about the cutting edge 307C in FIG. 14).

In the exemplified embodiment, for each of the rhombus-shaped apertures 305C, the shearing portion 330C comprises an inclined section 332C. The inclined section forms an acute angle β with a reference line RL on the outer surface 302C of the cutter tube 301C (which is also the outer surface of the rotary cutter 300C) that is parallel to the rotational axis R-R. For each of the rhombus-shaped apertures 305C, the non-shearing portion 331C comprises a first circumferential section 334C and a second circumferential section 335C, wherein each of the first and second circumferential sections 334C, 335C are orthogonal to the reference line RL. The non-shearing portion 331C also comprises an inclined section 336C. The inclined section 336C forms an acute angle α with the reference line RL. In the exemplified embodiment, the acute angle α is substantially equal to the acute angle β. In certain other embodiments, the acute angle α is different than the acute angle β. The acute angles β and α may be between 10° to 60° in certain embodiments.

For purposes of explanation, the chevron shaped apertures 305C are identical to the rhombus shaped apertures 305C as discussed above with the exception of their shape. Specifically, each of the chevron shaped apertures have a shape that is similar to that discussed above for the apertures 305A of FIG. 10. Thus, the explanation of the geometry of the apertures 305A can be applied to the chevron shaped apertures 305C as if set forth herein fully.

As best shown in FIG. 13, the pattern of the apertures 305C is such that no more than two of the shearing portions 330C are capable of being active in shearing the user's hair with the cutting edge 351 of the fixed blade when the rotary cutter 300C is rotating about the rotational axis R-R. Thought of another way, the pattern of the apertures 305C is such that a projected reference line PRL of the cutting edge 351 of the fixed blade 350 on the outer surface 302C of the cutting tube 300C intersects no more than two of the shearing portions 330C irrespective of the angular position of the rotary cutter 300C.

For example, for the angular position illustrated in FIG. 13, it can be seen that the projected reference line PRL intersects the shearing portions 330C of only two of the apertures 305C, namely at first and second intersection points IP1 and IP2. While the projected reference line PRL may intersect many of the non-shearing portions 330C at this angular position, only two shearing portions 330C are intersected. During operation of the shaving apparatus 1000 in which the rotary cutter 300C is incorporated, it is only those shearing portions 330C that intersect the projected reference line PRL that are capable of being active to shear the user's hair with the cutting edge 351 of the fixed blade 350 at any given point in time.

As the rotary cutter 300C is rotated about the rotational axis R-R in the angular direction AD1, the angular position of the rotary cutter 300C advances so as to advance the pattern of the apertures 305C (left-to-right in FIG. 13) toward the cutting edge 351 of the fixed blade 350 (the fixed blade 350 remaining stationary). As a result, the position of projected reference line PRL is effectively translated across the entirety of the pattern of apertures 305C. Despite this, at any given position of the projected reference line PRL relative to the pattern of apertures 305C, the projected reference line PRL never intersects more than two of the shearing portions 330C at any given point in time. Thus, the torque requirements of the motor 400 can be precisely controlled by properly designing the pattern of apertures 305C.

Additionally, it can be seen that the pattern of apertures 305C is designed such that the first and second intersection points IP1 and IP2 are located on opposite sides of the reference centerline RCL. More specifically, in order to impart a balanced load on the rotary cuter 300C, the first and second intersection points IP1 and IP2 may be equidistant from the reference centerline RCL in certain embodiments.

In a non-illustrated embodiment, the pattern of apertures 305C of FIGS. 13-14 could be modified such that there only one shearing portion 330C is capable of being active in shearing the user's hair with the cutting edge 351 of the fixed blade when the rotary cutter 300C is rotating about the rotational axis R-R. In other words, the pattern of the apertures 305C of FIGS. 13-14 can be modified such that the projected reference line PRL intersects only one of the shearing portions 330C irrespective of the angular position of the rotary cutter 300C. Such a modification would entail modifying the rows 390C of apertures 305C such that the reference row line RRL would be linear for the entirety of its length and arranged at an appropriate acute angle δ relative to the reference line RL (see FIG. 15 for this angle).

In a certain other embodiment, the invention may directed to instances where the projected reference line PRL intersects more than two of the shearing portions 330C of the apertures 307C when in certain angular positions but the pattern is designed such that each of the rows 309C includes both shearing portions 330C that are intersected by the projected reference line PRL and shearing portions 330C that are not intersected by the projected reference line PRL when the rotary cutter is at a given angular position.

Figure 15:
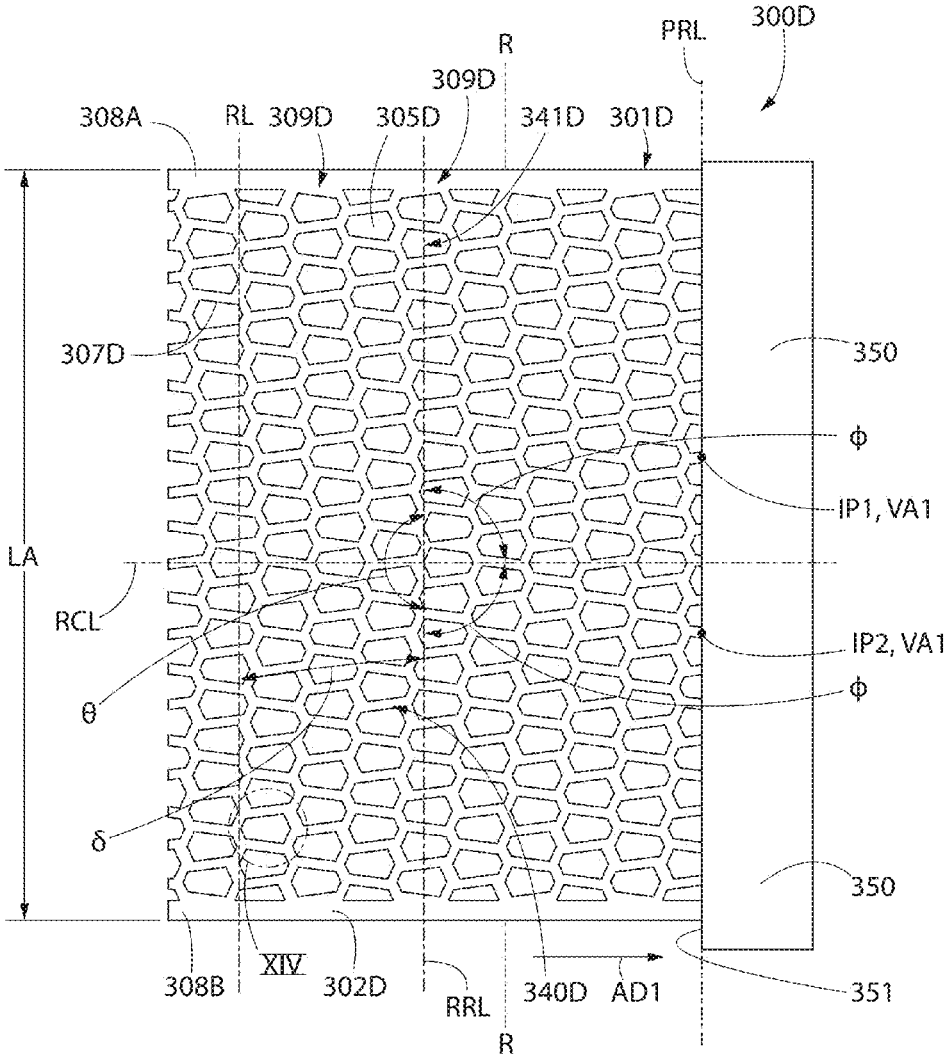
FIG. 15 is a schematic illustrating how the cutting edges of a rotary cutter having a fourth alternative pattern of apertures interact with a fixed blade when utilized in the shaving apparatus of FIG. 1.
Figure 16:
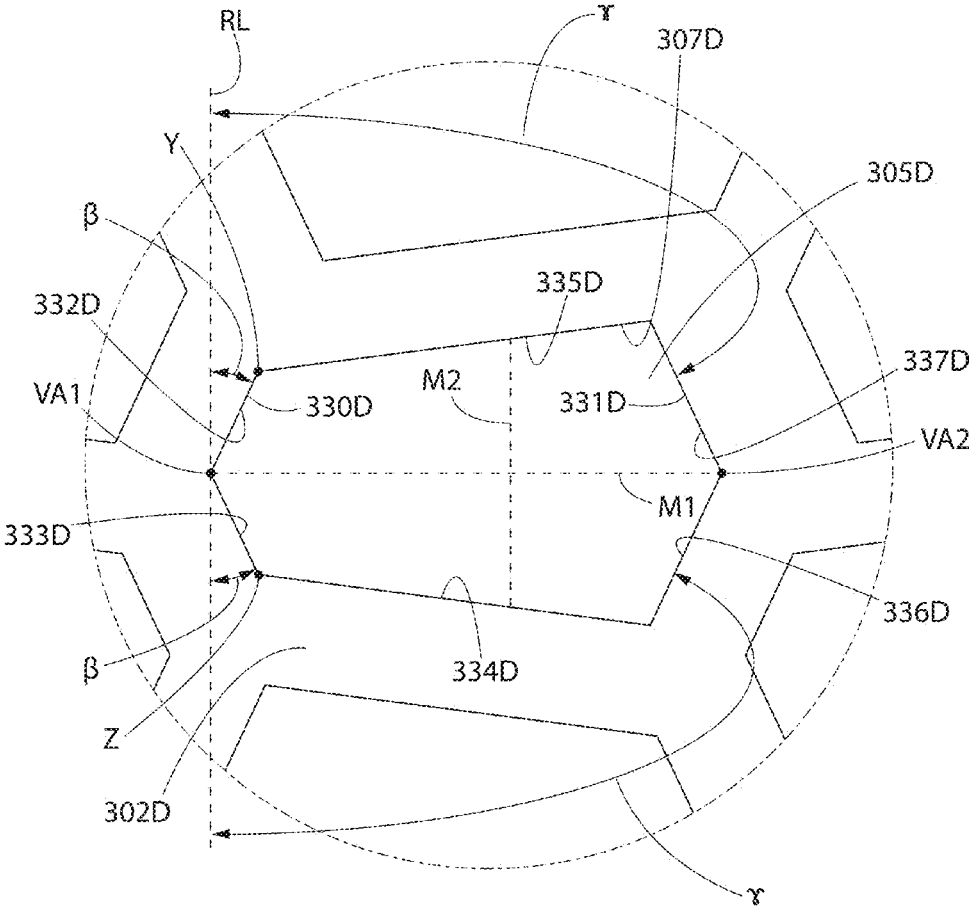
FIG. 16 is a close-up view of area XVI of FIG. 15.

Referring now to FIGS. 15-16, a rotary cutter 300D is exemplified that comprises a cutter tube 301D including apertures 307D arranged in a fourth alternate pattern. The fourth alternate pattern of the apertures 307D is specifically designed so that the so that only a selected number of shearing portion apexes of the cutting edges 307D of the apertures 305D are capable of actively shearing hairs with the fixed blade 350 at any given point in time. Moreover, the fourth alternate pattern of the apertures 307D is specifically designed so that the rotary cutter 300D may be subjected to a substantially balanced load that results from the reactionary forces imparted on the rotary cutter 300D by the hairs during the shearing process that takes place with the cutting edge 351 of the fixed blade 350 during a shaving process. As a result, the torque requirements of the motor 400 can be optimized and the rotary cutter 300D may more accurately maintain its proper shape and spacing with the fixed blade 350.

In the fourth alternate pattern, the apertures 305D are arranged in a plurality of rows 309D. The apertures 305D of each of the rows 309D are arranged so that their centers are located along a reference row line RRL. Each of the rows 309D comprise a first row section 340D located on one side of the reference centerline RCL (which divides the axial length LA of the rotary cutter 300D in half) and a second row section 340D located on an opposite side of the reference centerline RCL. The first and second row sections 340D, 341D collectively form the row 309D. The portion of the reference row line RRL that extends along the first row portion 340D and the portion of reference row line RRL that extends along the first row portion 340D intersect at the reference centerline RCL to form an angle θ that is less than 180°. Moreover, the portion of the reference row line RRL that extends along the first row portion 340D and the portion of the reference row line RRL that extends along the first row portion 340D each form an obtuse angle ϕ with the reference centerline RCL. The two obtuse angles ϕ and the angle θ collectively add up to 360°. The pattern of the apertures 305D is symmetric about the reference centerline RCL (which divides the axial length LA of the rotary cutter 300D in half). In this specific embodiment, the portion of the pattern on one side of the reference centerline RCL is a mirror image of the portion of the pattern on the opposite side of the reference centerline RCL.

Each of the apertures 305D has a hexagonal shape. In the exemplified embodiment, each of the apertures 305D is also circumferentially elongated such that aperture 305D comprises a major axis M1 and a minor axis M2 wherein M1 is longer than M2. Each of the apertures 305D are symmetric about their major axis M1 but asymmetric about their minor M2. Moreover, the apertures 305D are arranged in the rows 309D so as to be alternating pattern so that adjacent apertures in the row 309D are rotated 180° about their center point.

Each of the apertures 305D is defined by a cutting edge 307D that defines a closed-geometry. Each of the cutting edges 307D comprises a shearing portion 330D and a non-shearing portion 331D. In the exemplified embodiment in which the rotary cutter 300D is rotated about the rotational axis R-R in the angular direction AD1, the shearing portion 330D extends from point Y to point Z and includes the first valley apex VA1 while the non-shearing portion 331D extend from point Z to point Y and includes the second valley apex VA2.

In the exemplified embodiment, for each of the apertures 305D, the shearing portion 330D comprises a first inclined section 332D and a second inclined section 333D that converge to form the first valley apex VA1. Each of the first and second inclined sections 332D, 333D form an acute angle β with the reference line RL. For each of the apertures 305D, the non-shearing portion 331D comprises a first circumferential section 334D and a second circumferential section 335D, wherein each of the first and second circumferential sections 334D, 335D are non-orthogonal to the reference line RL. The non-shearing portion 331D also comprises a first inclined section 336D and a second inclined section 337D that converge to form the second valley apex VA2. Each of the first and second inclined sections 336D, 337D form an obtuse angle γ with the reference line RL. The obtuse angle γ and the acute angle β may be supplementary to one another in certain embodiments. In certain other embodiments, the obtuse angle γ and the acute angle β may not be supplementary. The acute angle β may be between 10° to 60° in certain embodiments while the obtuse angle γ may be between 90° to 150° in certain embodiments.

As best shown in FIG. 15, the pattern of the apertures 305D is such that no more than two apexes (which are valley apexes VA1 in the exemplified embodiment) of the shearing portions 330D are capable of being active in shearing the user's hair with the cutting edge 351 of the fixed blade when the rotary cutter 300D is rotating about the rotational axis R-R. Thought of another way, the pattern of the apertures 305D is such that a projected reference line PRL of the cutting edge 351 of the fixed blade 350 on the outer surface 302D of the cutting tube 300D intersects no more than two of the apexes (which are valley apexes VA1 in the exemplified embodiment) of the shearing portions 330D irrespective of the angular position of the rotary cutter 300D.

For example, for the angular position illustrated in FIG. 15, it can be seen that the projected reference line PRL intersects only two apexes VA1 of the shearing portions 330D of the apertures 305D, namely at the first and second intersection points IP1 and IP2. While the projected reference line PRL may intersect many of the non-shearing portions 330D (or the apexes thereof) at this angular position, only two apexes AV1 of the shearing portions 330D are intersected. During operation of the shaving apparatus 1000 in which the rotary cutter 300D is incorporated, only those apexes AV1 of the shearing portions 330D that intersect the projected reference line PRL are capable of being active to shear the user's hair with the cutting edge 351 of the fixed blade 350 at any given point in time.

As the rotary cutter 300D is rotated about the rotational axis R-R in the angular direction AD1, the angular position of the rotary cutter 300D advances so as to advance the pattern of the apertures 305D (left-to-right in FIG. 15) toward the cutting edge 351 of the fixed blade 350 (the fixed blade 350 remaining stationary). As a result, the position of projected reference line PRL is effectively translated across the entirety of the pattern of apertures 305D. Despite this, at any given position of the projected reference line PRL relative to the pattern of apertures 305D, the projected reference line PRL never intersects more than two of the apexes AV1 of the shearing portions 330C at any given point in time. Thus, the torque requirements of the motor 400 can be precisely controlled by properly designing the pattern of apertures 305C.

Additionally, it can be seen that the pattern of apertures 305D is designed such that the first and second apexes AV1 that are intersected by the projected reference line PRL at intersection points IP1 and IP2 are located on opposite sides of the reference centerline RCL. More specifically, in order to impart a balanced load on the rotary cuter 300D, the first and second apexes AV1 that are intersected by the projected reference line PRL at intersection points IP1 and IP2 may be equidistant from the reference centerline RCL in certain embodiments.

Figure 17:
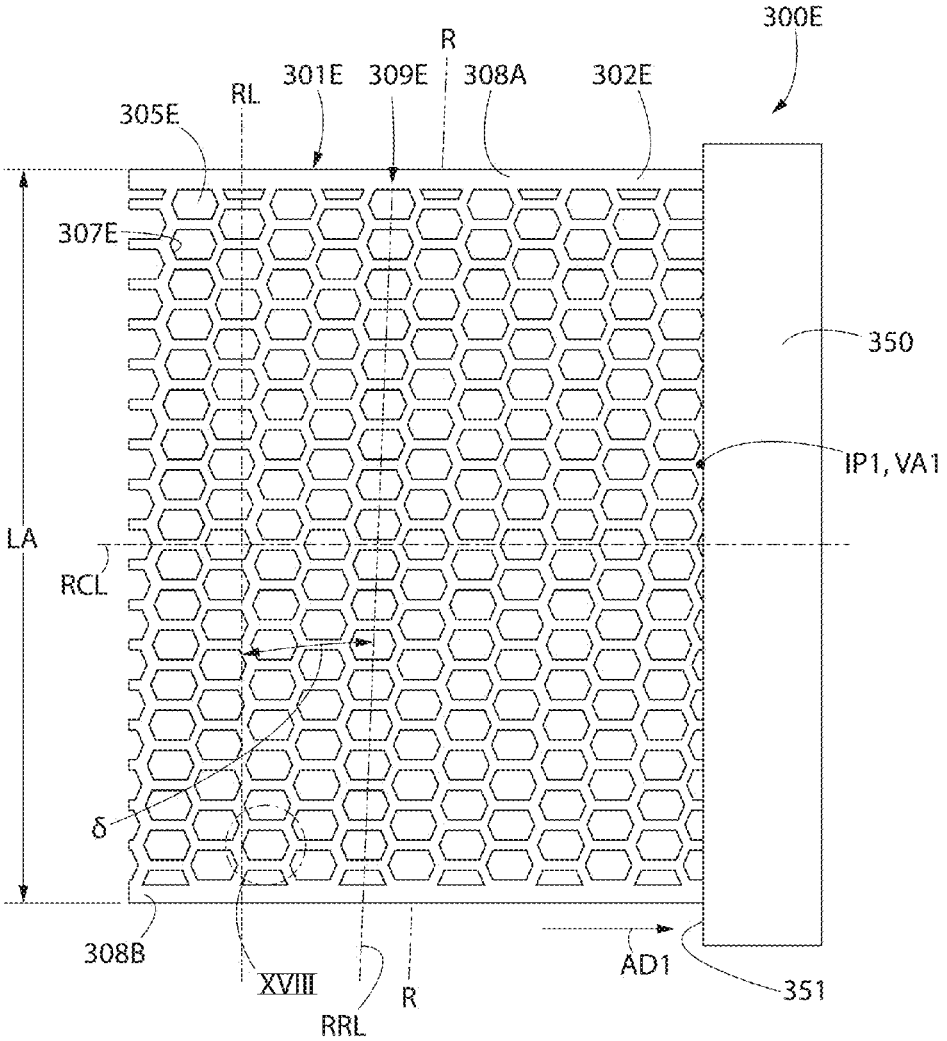
FIG. 17 is a schematic illustrating how the cutting edges of a rotary cutter having a fifth alternative pattern of apertures interact with a fixed blade when utilized in the shaving apparatus of FIG. 1.
Figure 18:
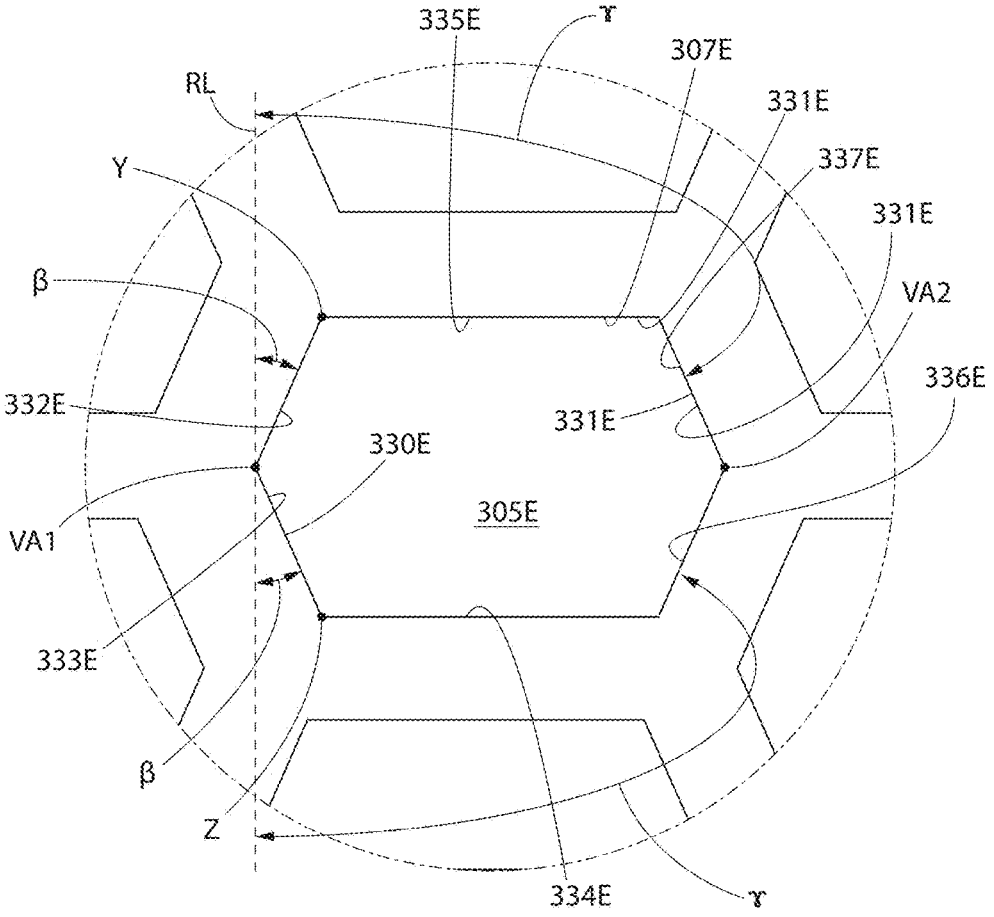
FIG. 18 is a close-up view of area XVIII of FIG. 17.
Figure 19:
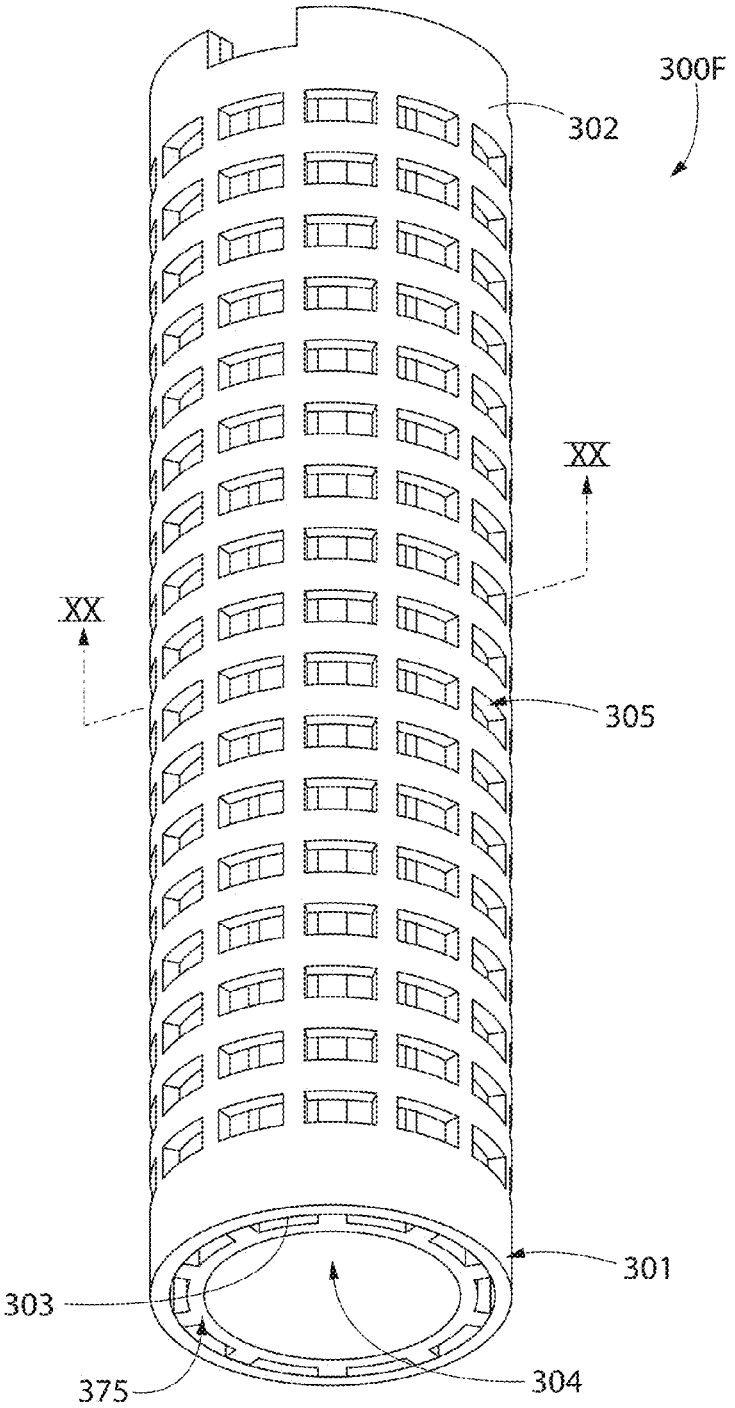
FIG. 19 is a perspective of a rotary cutter that can be used with the shaving apparatus of FIG. 1 according to the present invention, wherein the rotary cutter comprises a cutting tube and a support tube.
Figure 20:
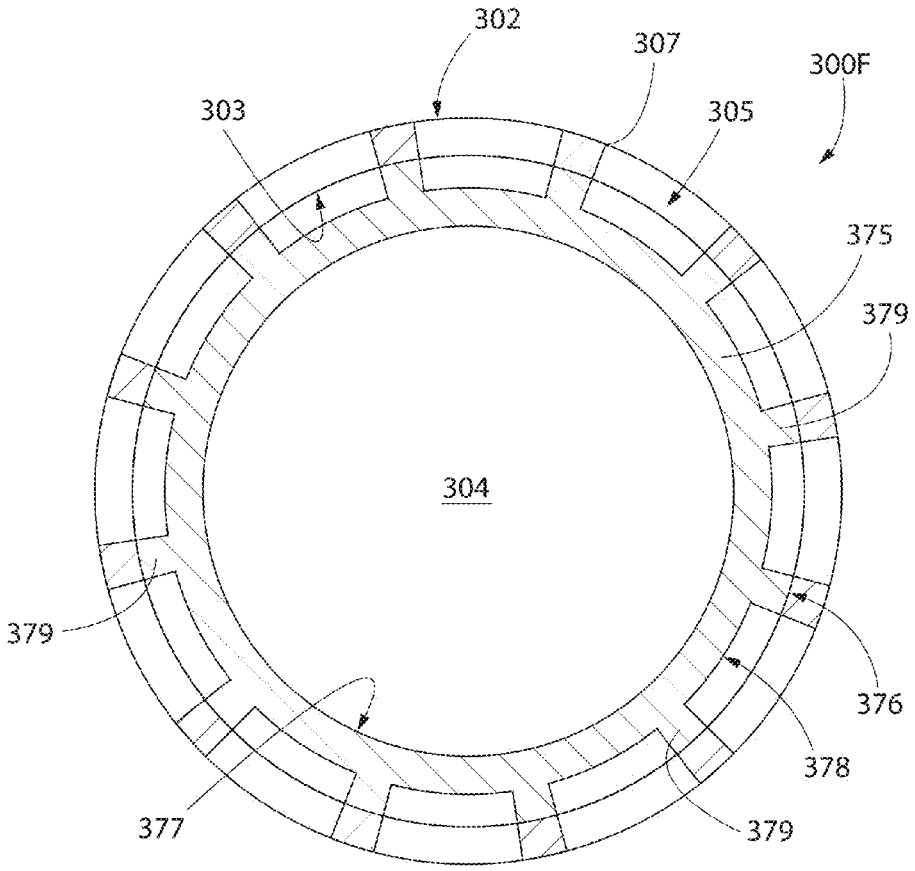
FIG. 20 is transverse cross-sectional view of the rotary cutter of FIG. 19 taken along view XX-XX.
Figure 21:
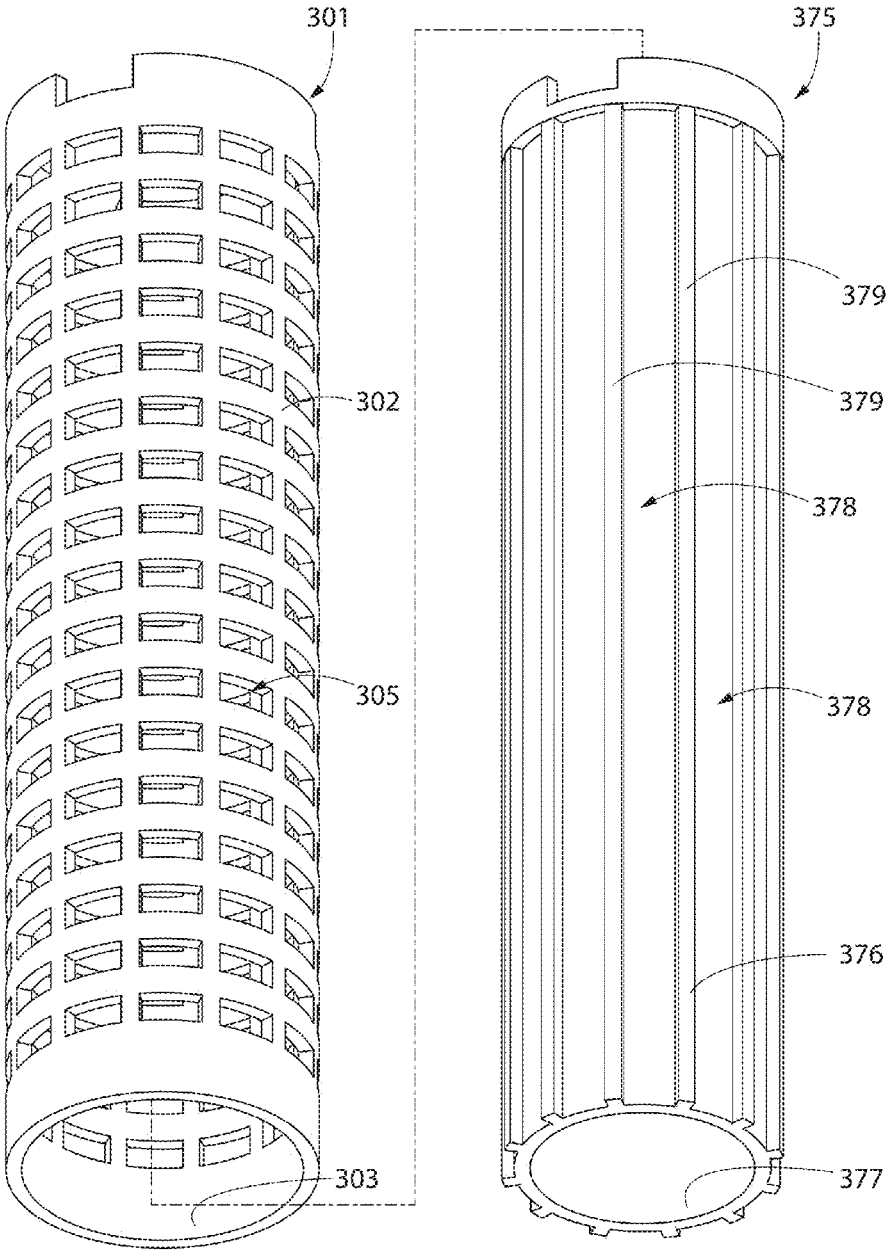
FIG. 21 is an exploded view of the rotary cutter of FIG. 19.

Referring now to FIGS. 17-18, a rotary cutter 300E is exemplified that comprises a cutter tube 301E including apertures 307E arranged in a fourth alternate pattern. The fourth alternate pattern of the apertures 307E is specifically designed so that the so that only a selected number of shearing portion apexes of the cutting edges 307E of the apertures 305E are capable of actively shearing hairs with the fixed blade 350 at any given point in time. Specifically, the fourth alternate pattern of the apertures 307E is designed such that only one shearing portion apex is capable of actively shearing hairs with the fixed blade 350 at any given point in time. The fourth alternate pattern of the apertures 307E comprises hexagonal apertures similar to those described above for FIGS. 11 and 12. Thus, no further explanation is required in this regard. Moreover, with respect to achieving the goal that only one shearing portion apex is capable of actively shearing hairs with the fixed blade 350 at any given point in time, the rotary cutter 300E is similar to the rotary cutter 300D discussed above for FIGS. 15-16. Thus, only the difference between the fourth alternate pattern of the apertures 307E and the third alternate pattern of the apertures 307D that achieves this single shearing portion apex functionality will be discussed to avoid redundancy.

To this end, in order that only one apex VA1 of the shearing portion 3330E of the apertures 307E be active in shearing hairs with the fixed blade 350 at any given point in time, the fourth alternate pattern of the apertures 307E is designed such that the projected reference line PRL intersects only one apex VA1 of the shearing portions 330E at the intersection point IP1 (irrespective of the angular position of the rotary cutter 300E). This is achieved by modifying the rows 390E of the apertures 305E such that the reference row line RRL is linear for the entirety of its length and arranged at an appropriate acute angle δ relative to the reference line RL (see FIG. 17 for this angle).

Referring now to FIGS. 19-22 concurrently, a rotary cutter 300F according to an embodiment of the present invention is illustrated that can be used in the shaving apparatus 1000. The rotary cutter 300F generally comprises the cutter tube 301 (described above in relation to FIGS. 1-9) and a support tube 375. In order to avoid redundancy, the details of the cutter tube 301 will be omitted in the below discussion with the understanding that the discussion of the cutter tube 301 in relation to FIGS. 1-9 is applicable. Moreover, it is to be understood that any of the alternative aperture patterns of FIGS. 10-18 (and the associated concepts) can be applied to the cutter tube that is used in the rotary cutter 300F.

The cutter tube 301 is mounted on the support tube 375. The support tube 375, in certain embodiments, may provide a degree of structural rigidity to the cutter tube 301 so that the cutter tube 301 does not become deformed or warped over time during use. Moreover, the structural support provided by the support tube 375 may help maintain a appropriate and consistent spacing between the cutting edges 307 of the rotary cutter 300F and the cutting edge 351 of the fixed blade 350. The support tube 375 can be formed of a wide variety of materials, including plastics and metals. The support tube 375, in certain embodiments, may have a thickness in a range of 0.2 mm to 5 mm (measure from the inner surface 377 to the outer surface 376).

The cutter tube 301 is mounted to the support tube 375 so that the inner surface 303 of the cutter tube 301 is in surface contact with an outer surface 376 of the support tube 375. The cutter tube 301 is non-rotatable relative to the support tube 375. Thus, the cutter tube 301 and the support tube 375 rotate as a collective unit during rotation of the rotary cutter 300F. The cutter tube 301 may be fixed relative to the support tube 375 by a friction fit, mating engagement of features, a fastener, adhesive, thermal fusion, brazing, welding, or other means used to couple such articles together. For example, in one embodiment, the support tube 375 may have one or features that will align with corresponding features in the cutter tube 301, such that once placed and secured thereto, there will be no relative motion between the cutter and support tubes 301, 375. In one such embodiment, a small pin protruding out of the outer diameter of the support tube 375 will align with and engage a corresponding slot or hole in the cutter tube 301.

In another example, a friction fit between the cutter tube 301 and the support tube 375 prevents relative rotation between the two. In one such embodiment, the cutter and support tubes 301, 375 can be assembled by shrink fitting, which may include heating the cutter tube 301 and/or or cooling of the support tube 375 such that a gap is created between the outer diameter of the support tube 375 and the inner diameter of the cutter tube 301. Once a sufficient gap exists, the cutter tube 301 may be slid over the support tube 375. Subsequent return to the same temperature results in the cutter and support tubes 301, 375 being friction fit together.

The support tube 375 comprises a plurality of depressions 378 formed into its outer surface 376. In the exemplified embodiment, the depressions 378 are in the form elongated axial channels. As a result of the depressions 378 being elongated axial channels, a plurality of axial ribs 379 are formed that separate adjacent depressions 378. The axial ribs 379 may be continuous (as exemplified) or segmented. In the exemplified embodiment, it is the terminal surfaces of the ribs 379 that collectively define the outer surface 376 of the support tube 375. The depressions 378, while being exemplified as channels, can take on a wide variety of shapes and orientations. In another embodiment, the depressions 378 can take the form of dimples. In still another embodiment, the depressions 378 can take the form of a floor of a basin from which a plurality of protuberance extend, wherein the terminal surface of the protuberances would collectively form the outer surface 376 of the support tube 375.

In certain embodiment, the cutter tube 301 is coupled to the support tube 375 so that at least some of the apertures 305 of the cutter tube form passageways through the cutter tube 301 and into the depressions 378 of the support tube 301. Such an arrangement allows longer hairs to be fed into the rotary cutter 300F for shearing, thereby allowing the cutter tube 301 to be very thin, such as foil, without limiting the ability of the rotary cutter 300F to shear longer hairs.

Figure 23:
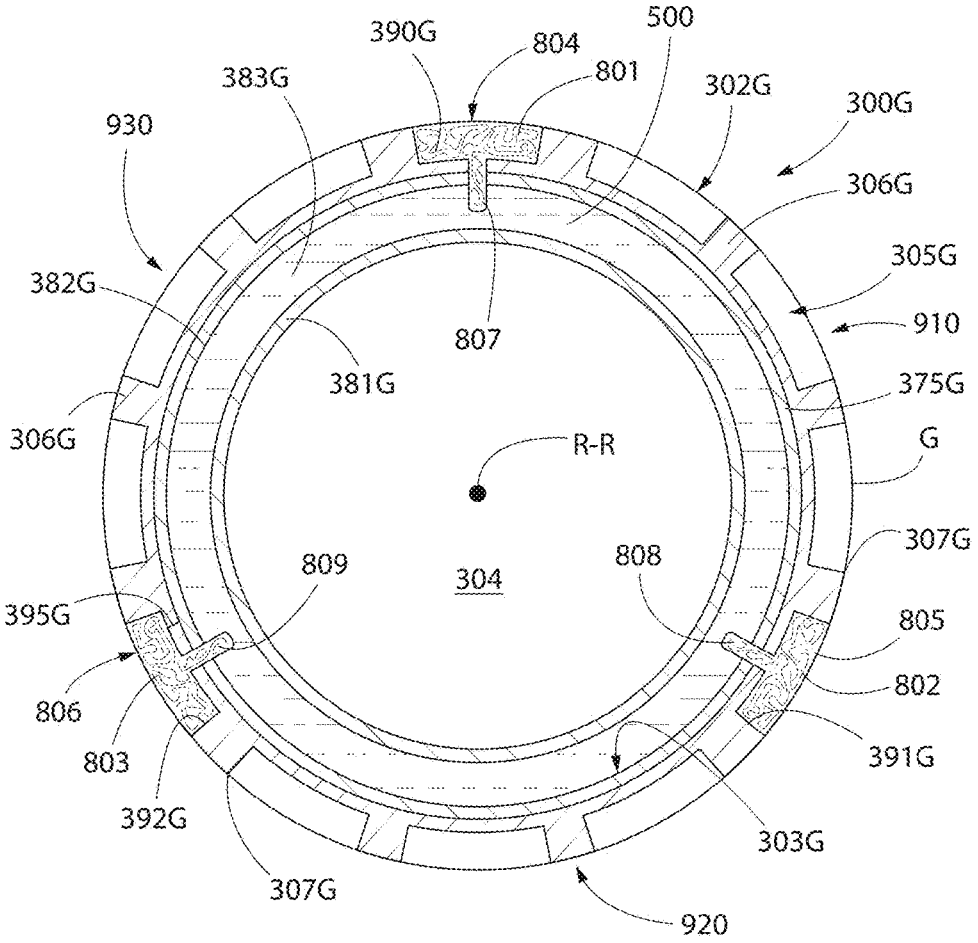
FIG. 23 is transverse cross-sectional view of the rotary cutter of FIG. 22 taken along view XXIII-XXIII.

Referring now to FIGS. 22-23 a rotary cutter 300G having a lubricating element 800 coupled thereto is illustrated in accordance with an embodiment of the present invention. The rotary cutter 300G with the coupled lubricating element 800 can be utilized in the shaving apparatus 1000 of FIGS. 1-9 in place of the rotary cutter 300. The rotary cutter 300G is identical to the rotary cutter 300 of FIGS. 1-9 with certain exceptions discussed below to accommodate and facilitate recharging of the lubricating element 800. Thus, the discussion of the rotary cutter 300G will be limited to those aspects of the rotary cutter 300G that differ from the rotary cutter 300 with the understanding that the discussion above relating to the rotary cutter 300 is applicable thereto. Therefore, like reference numbers will be used to identify like elements with the addition of the alphabetical suffix "G."

The lubricating element 800 is coupled to the cuter tube 301G of the rotary cutter 300G for rotation therewith about the rotational axis R-R during operation of the motor 400.

When assembled into the shaving apparatus 1000 as discussed above for the rotary cutter 300, rotating the assemblage of the rotary cutter 300 and the lubricating element 800 during a shaving operation causes: (1) the lubricating element 800 to apply a lubricant to a user's skin; and (2) the user's hairs are sheared between the cutting edge 351 of the fixed blade 350 and the cutting edges 307G of the rotary cutter 300G. The lubricating element 800 may apply the lubricant to the user's skin by contacting the user's skin (direct application) and/or by releasing the lubricant (indirect application), which may be caused by centrifugal force experienced by the lubricating element 800 during rotation. Thus, as the rotary cutter 300G rotates, the lubricating element 800 may lubricate the area of the skin being shaved, at least once, but most likely, multiple times, just prior to the hair shearing process, at which point the skin is closest to the fixed blade 350.

In one embodiment, the lubricating element 800 comprises a matrix material 804 that carries a desired fluidic lubricant suitable for shaving. The matrix material may take the form of a porous material, a fibrous material, or other materials capable of absorbing, retaining, and subsequently releasing the selected lubricant. One example of a matrix material comprises a water-insoluble polymer matrix, such as polystyrene. Suitable lubricants include, without limitation, dermal lotions, lanolins, oils, moisturizers, emollients, and the like. Additional ingredients in the lubricant, may comprise, for example, (1) skin health-related ingredients such as dermatologic agents (acne, flaky, itchy), balancing agents (dry or oily skin, pH correct, moisturizers, seasonal solution), rejuvenation/revitalization agents (vitamin therapy, herbal, conditioners, acids, cell renewal), cleansing agents (antibacterial, natural, hypoallergenic, botanical-derived, fragrant or fragrance free), or skin-protective agents (UV, anti-aging, anti-wrinkle); (2) skin sensation agents such as menthol, or pain-relief (aspirin); (3) soothing agents including neosporin; (4) hair treating agents such as beard softeners, hair growth inhibitors, hair outer layer degradants, hair hydrating agents, hair conditioners, or hair thinning agents; (5) cosmetics such as tanning agents; (6) aromatherapeutants including perfumes or essences; and (7) other agents such as oil, milks, honey, gels, creams, balms, catalysts, or effervescents.

The lubricating element 800 has an outer surface (collectively formed by outer surfaces 804-806 of the strips 801-803 in the exemplified embodiment) that is flush with the outer surface 302G of the cutter tube 301G of the rotary cutter 300G. As discussed above, the outer surface 302G of the cutter tube 301G also comprises the cutting edges 307G that define the apertures 305G. Thus, the outer surface 302G of the cutter tube 301G and the outer surface (surface 804-806 as exemplified) of the lubricating element 800 collectively define a reference circle G that is centered about the rotational axis R-R. By making the outer surface of the lubricating element 800 flush with the outer surface 302G of the cutter tube 301G, the lubricating element 800 does not interfere with and/or contact the cutting edge 351 of the fixed blade 350 during shaving. In certain embodiments, the outer surface of the lubricating element 800 may protrude slightly from the outer surface 302G of the cutter tube 301G so long as the distance of protrusion is less than the distance of the cutting gap 325 (see FIG. 9A) so that the lubricating element 800 does not contact the fixed blade 350 during rotation.

In an embodiment, the outer surfaces 804-806 of the lubricating strips 801-803 are slightly recessed with respect to the outer surface 302G of the rotary cutter 301G when they are dry. However, when the lubricating strips 801-803 are loaded with the lubricant, the lubricating strips 801-803 may expand such that the outer surfaces 804-806 of the lubricating strips 801-803 become flush with the outer surface 302G of the rotary cutter 301G. In one embodiment, the lubricating element 800 is assembled and stored dry and wetted with moisturizing lotion at a later time, e.g. when the razor is first used, e.g. when the cutter tube 301G is assembled into the shaving head 200.

In the exemplified embodiment, the lubricating element 800 is in the form of a plurality of elongated lubricating strips 801-803. While three lubricating strips 801-803 are exemplified, any number of lubricating strips 801-803 can be utilized as desired, including one, to form the lubricant element 800. Moreover, while the lubricating element 800 is exemplified as one or more elongated lubricating strips 801-803, the lubricating element 800 could take on a wide variety of other shapes and forms. In certain other embodiments, for example, the lubricating element 800 can be in the form of isolated lubricating regions, such as circles, polygons, or other closed-geometries structures/pads, which arranged on the outer surface 302G of the cutter tube 301G in a spaced-apart manner.

Each of the lubricating strips 801-803 are located within depressions 390G-392G formed in the outer surface 302G of the cutter tube 301G. Each of the depressions 390G-392G is in the form of an elongated axial slot that is sized and shaped to receive a corresponding one of the lubricating strips 801-803. As such, the lubricating strips 801-803 are embedded in the cutter tube 301G.

In the exemplified embodiments, the lubricating strips 801-803 are arranged about the outer surface 302G of the cutter tube 30G in a circumferentially space-part manner. The lubricating strips 801-803 extend the entire axial length of the cutter tube 301G, thereby forming a plurality of isolated shearing zones 910, 920, 930 on the outer surface 302G of the cutter tube 301G. Each of the shearing zones 910, 920, 930 comprises a plurality of the apertures 305G that are defined by closed-geometry cutting edges 307G.

In one embodiment, the cutter tube 301G may be manufactured from a flat stock metal sheet, such as a foil. In such an embodiment, the flat stock is rolled to form the cutter tube 301G and the ends are connected together. In such a formation process, it may be challenging to align the ends adequately and create a smooth seam. In one embodiment in which the lubricating element 800 is utilized, this seam (such as the one indicated at 395G) may be located on the floor of one of the depressions 390G-392G and subsequently covered by one of the lubricating strips 801-803, thereby simplifying the manufacture process.

In certain embodiments, an internal reservoir of the lubricant may be provided either in the handle 100 or in the head 200 of the shaving apparatus 1000 in order to recharge the lubricating element 800 over time so as to prevent drying out and prolonging the effective life of the lubricating element 800. The internal reservoir can be an empty volume filled with the lubricant or can include a porous material in an internal chamber that is saturated with the lubricant. Irrespective of the details and/or location of the reservoir, the lubricating element 800 is either continuously or intermittently in fluid communication with the reservoir so that lubricant in the reservoir can flow to the lubricating element 800 as desired for application to the user's skin during the shaving process.

Referring still to FIG. 23, in this exemplified embodiment, a reservoir 500 of the lubricant is located within the rotary cutter 300G. In this specific embodiment, the reservoir is formed in a modified version of the support tube 375G (see discussion above with respect to FIGS. 19-21). In this embodiment, the support tube 375G comprises an inner layer 381G and an outer layer 382G. An annular space 383G is formed between the inner and outer layers 381G-382G that is filled with a store of the lubricant, thereby forming the reservoir 500 of the lubricant. Each of the lubricating strips 801-803 are fluidly coupled to the reservoir 500 of the lubricant via posts 807-809 of the matrix material that can wick the lubricant into the lubricating strips 801-803 via capillary action. In this embodiment, the lubricating strips 801-803 are in continuous fluid communication with the reservoir and the lubricant is delivered solely by capillary action. In other embodiments (such as the on discussed below with respect to FIG. 24), an actuator can be supplied to supply pressure to the reservoir 500 of the lubricant, thereby flowing the lubricant to the lubricating strips 801-803. The actuator can either be manual, such as a button that can be pressed by the user or automated in that it is activated upon powering the motor 400. With the exception of being able to flow to the lubricating strips 801-803 the reservoir 500 of the lubricant is sealed. One way valves can be provided as needed.

Figure 24:
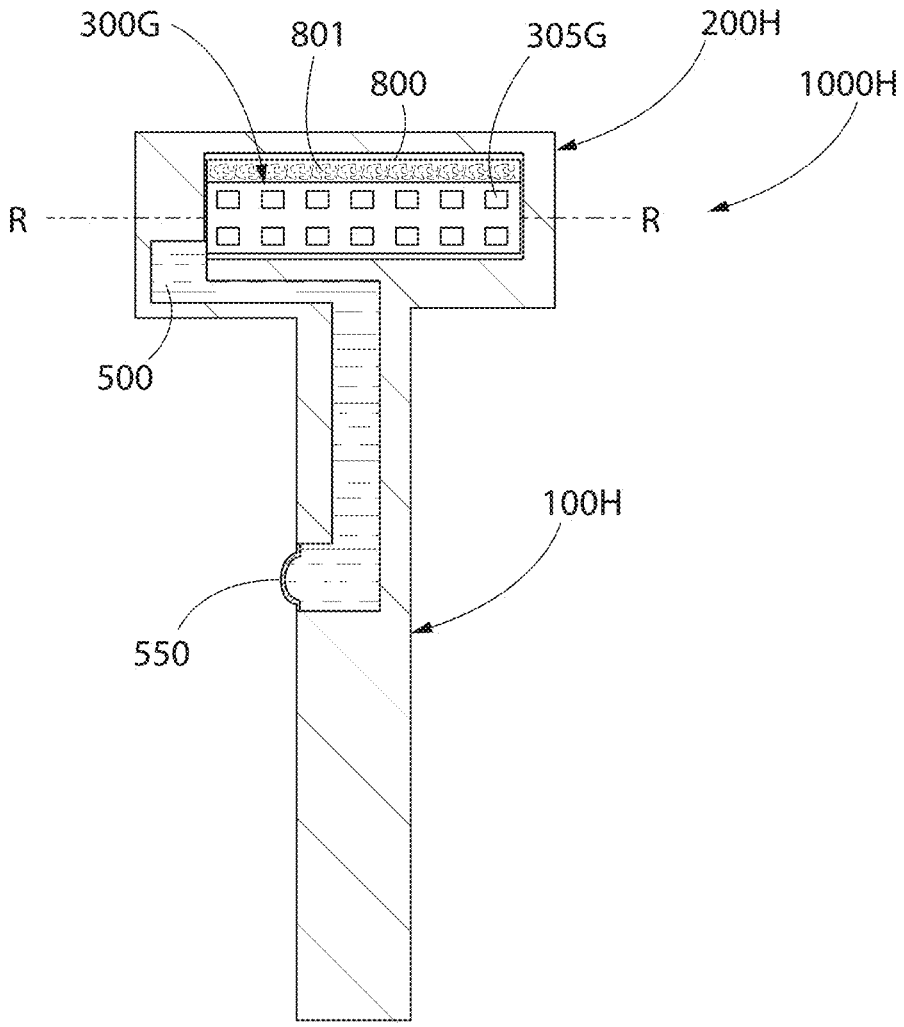
FIG. 24 is a schematic of a shaving apparatus comprising a reservoir that recharges a lubricating element coupled to a rotary cutter according to the present invention.

Referring now to FIG. 24 a shaving apparatus 1000H is exemplified. The shaving apparatus 1000H is identical to the shaving apparatus 1000 of FIGS. 1-9 with the exception that a reservoir 500 of the lubricant has been added and the rotary cutter 300G is utilized. Thus, the discussion of the shaving apparatus 1000H will be limited to those aspects that differ from the shaving apparatus 1000 with the understanding that the discussion above relating to the shaving apparatus 1000 is applicable thereto. Therefore, like reference numbers will be used to identify like elements with the addition of the alphabetical suffix "H."

In the shaving apparatus 1000H, the reservoir 500 of the lubricant is provided in both the head 200H and the handle 100H to recharge the lubricating element 800 of the rotary cutter 300G. The portion of the reservoir 500 that is positioned in the head 200H is adjacent the rotary cutter 300G such that when the rotary cutter 300G is rotated about the rotational axis R-R, each of the lubricating strips 801-803 of the lubricating element 800 come into and out of fluid coupling with the reservoir 500 of the lubricant as they pass thereby. As such, the lubricating strips 801-803 become recharged with the lubricant during the shaving process.

The shaving apparatus 1000H further comprises an actuator 550, which is in the form of a depressible button. The actuator 550 is operably coupled to the reservoir 500. When the actuator is depressed, the reservoir 500 is pressurized, thereby flowing additional lubricant to the lubricant strips 801-803. In still other embodiments, an actuator can be provided, such as a slide switch that is operably coupled to a translatable reservoir, that can bring the reservoir and the lubricating element into and out of fluid coupling upon actuation.

Figure 25:
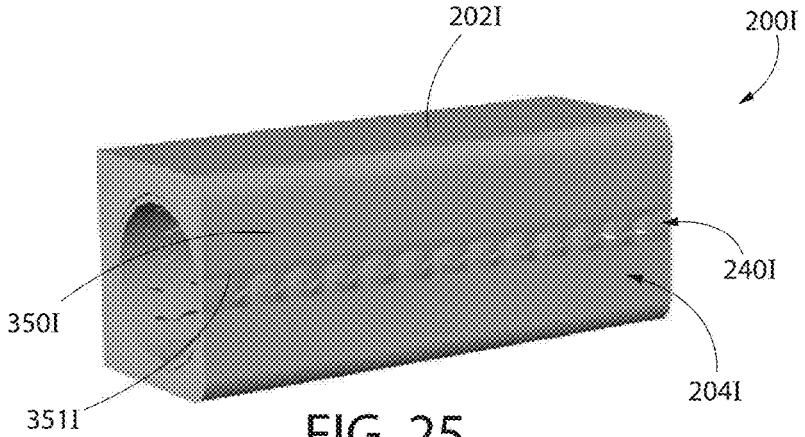
FIG. 25 is a perspective an first alternative head comprising a vibrating fixed blade that can be used with the shaving apparatus of FIG. 1.
Figure 26:
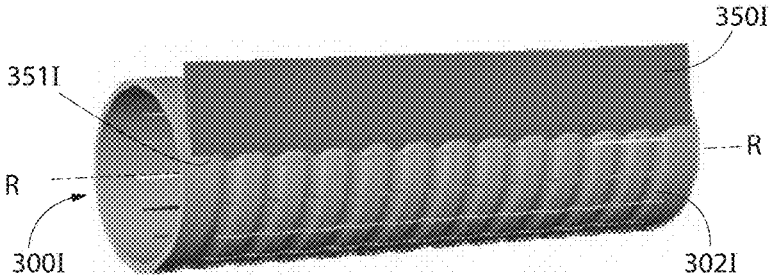
FIG. 26 is a perspective view of the vibrating fixed blade and the rotary cutter of the head portion of FIG. 25 removed from the housing.
Figure 27:
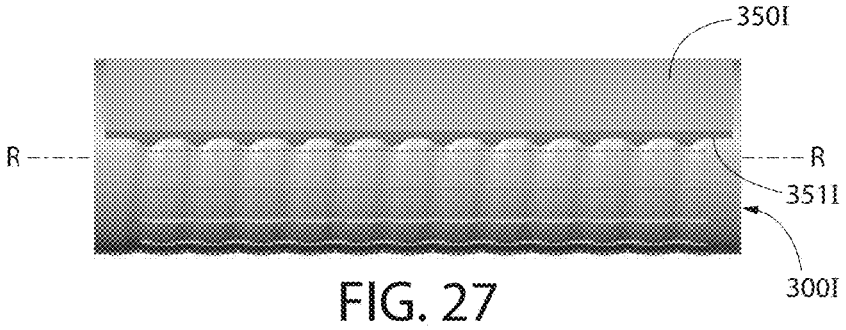
FIG. 27 is a plan view of the vibrating fixed blade and the rotary cutter of the head portion of FIG. 26.

Referring now to FIGS. 25-27 concurrently, a head 200I comprising a vibrating fixed blade 350I that can be used with the shaving apparatus 1000 is exemplified. The head 200I (along with its components) is identical to the head 200 of FIGS. 1-9 with the exception that the fixed blade 350I can vibrate and its cutting edge 315 has been modified to correspond to a modified rotary cutter 300I. Thus, the discussion of head 200I will be limited to those aspects that differ from the head 200 with the understanding that the discussion above is applicable thereto. Therefore, like reference numbers will be used to identify like elements with the addition of the alphabetical suffix "I."

In this embodiment, the shape of the cutting edge 351I of the fixed blade 350I is in the shape of a sine wave. Thus, the cutting edge 351I can be considered an undulating cutting edge having a plurality of peaks and valleys. The cutting edge 351I is designed to engage with corresponding peaks and valleys in the outer surface 302I of the rotary cutter 300I. More specifically, the fixed blade 351I is mounted adjacent the rotary cutter 300I so that the peaks of the undulating edge 351I of the fixed blade 350I nest in the valleys of the rotary cutter 300I while the peaks of the rotary cutter 300I nest in the valleys of the undulating edge 351I of the fixed blade 350I. The undulating design increases the effective length of the cutting edge 351I and provides a continuum of cutting angles between the cutting edge 351I of the fixed blade 350I and the rotary cutter 300I. The rotary cutter 300I comprises a plurality of elongated slit apertures 307I that form cutting edges of the rotary cutter 300I (which comprises a cutter tube as discussed above).

Each crest and valley may extend circumferentially about the outer surface 302I of the rotary cutter 300I so as to be oriented perpendicular to the rotational axis R-R (see FIG. 26). In another embodiment, the peaks and valleys of the rotary cutter 300I may extend circumferentially about the outer surface 302I of the rotary cutter 300I so as to be at a small incline relative to the rotation axis, wherein, each crest and valley defines a circumferential circle (see FIG. 27). The peaks and valleys do not form a spiral.

Additionally, the fixed blade 350I can move a short distance, parallel to the rotational axis R-R as is rides along the circumferential paths formed by the peaks and valleys in reciprocating manner. The fixed blade 350I has at least one feature, such as a pin that is aligned with a corresponding feature in the rotary cutter 300I, such as a slot, that is designed with the same incline as the peaks and valleys. When these two features interlock, and the rotary cutter 300I rotates about the rotational axis R-R, the fixed blade 350I will move in a linear motion, back and forth motion. The reciprocating linear motion is designed to be larger than the width of a hair, e.g. larger than 25 micron. In some cases it is larger than the amplitude of a crest and valley in the rotating cutter.

The fixed blade linear vibration frequency is determined by the rotation speed of the rotatory cutter and the design of the crest and valley of the rotating cutter. The vibrating fixed blade results in two scissor cutting modes simultaneously. The cutting mode, that is tangential to the circle defined by the rotating cutter, that is caused by the rotation of the rotating cutter with the ridges relative to the fixed blade, and a cutting mode that is parallel to the rotational axis R-R, that is caused by the fixed blade linear motion.

Figure 28:
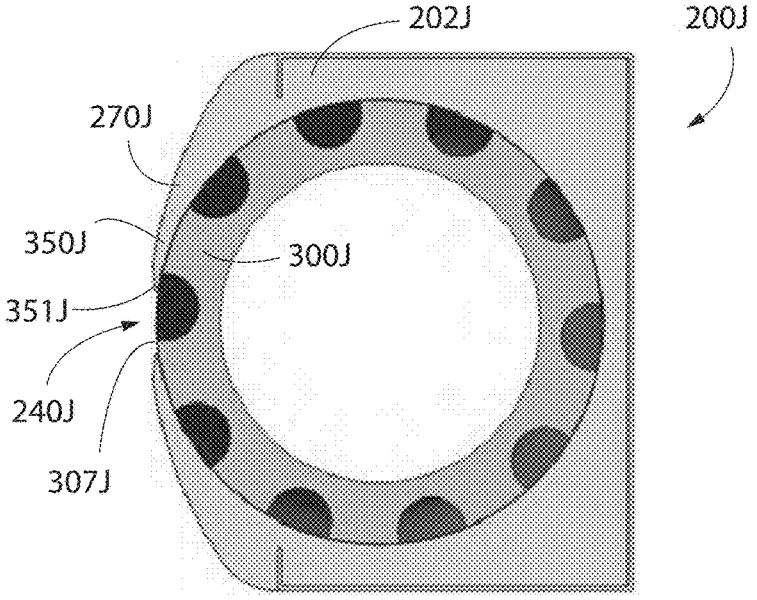
FIG. 28 is a schematic of a second alternative head comprising a housing having a rotary cutter mounted therein and a fixed blade integrally formed into the housing that can be used with the shaving apparatus of FIG. 1.

Referring now to FIG. 28, a head 200J having a fixed blade 350J that is integrally formed as part of the housing 202J that holds the rotary cutter 300J is illustrated. The head 200J (along with its components) is identical to the head 200 of FIGS. 1-9 with the exception that the fixed blade 350J is integrally formed as part of the housing 202J. Thus, the discussion of head 200J will be limited to those aspects that differ from the head 200 with the understanding that the discussion above is applicable thereto. Therefore, like reference numbers will be used to identify like elements with the addition of the alphabetical suffix "I."

The head 200J comprises a housing 202J that houses the rotary cutter 300J and other components as discussed above for the head 200. The head 200J, however, has a portion 270J that both forms a portion of the working surface and acts as an integrally formed fixed blade 350J. To this end, this portion 270J of the housing 202J terminates in a sharp edge 351J that defines one side of the elongated slot 240J and acts as the cutting edge 351J of the fixed blade 350J during the shearing of hairs in cooperation with the cutting edges 307J of the rotary cutter 300J. The housing 202J (and thus the cutting edge 351J) can be formed of any suitably hard and rigid materials, such as metal and hard plastics.

Figure 29:
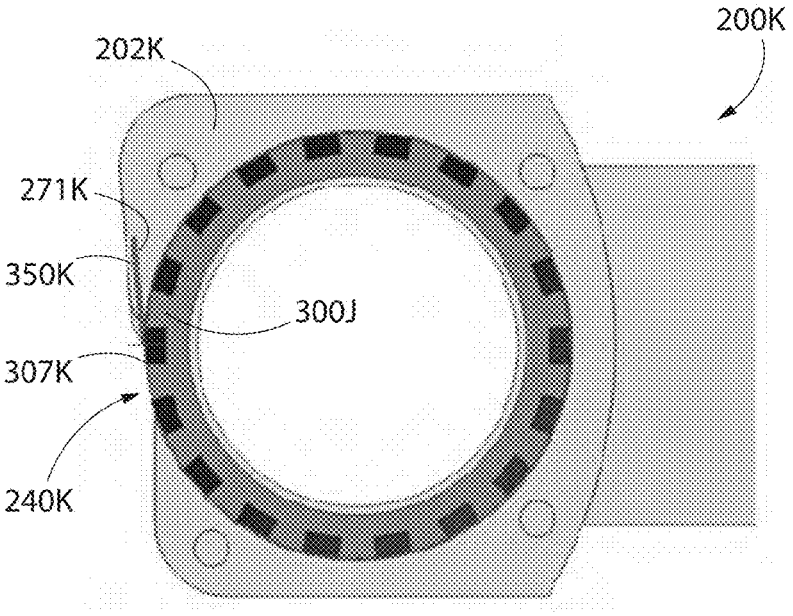
FIG. 29 is a schematic of a third alternative head comprising a housing having a rotary cutter mounted therein and a fixed blade mounted in a slot of the housing that can be used with the shaving apparatus of FIG. 1.

Referring now to FIG. 29, a head 200J having a fixed blade 350K that is mounted in a slot 271K formed in the housing 202K of the head 202K is illustrated. The head 200K (along with its components) is identical to the head 200 of FIGS. 1-9 with the exception that the fixed blade 350K is mounted in an internal slot 271K as shown. Thus, it is to be understood that the detailed discussion of head 200J above is applicable thereto. Therefore, like reference numbers have been used to identify like elements with the addition of the alphabetical suffix "K."

Figure 30:
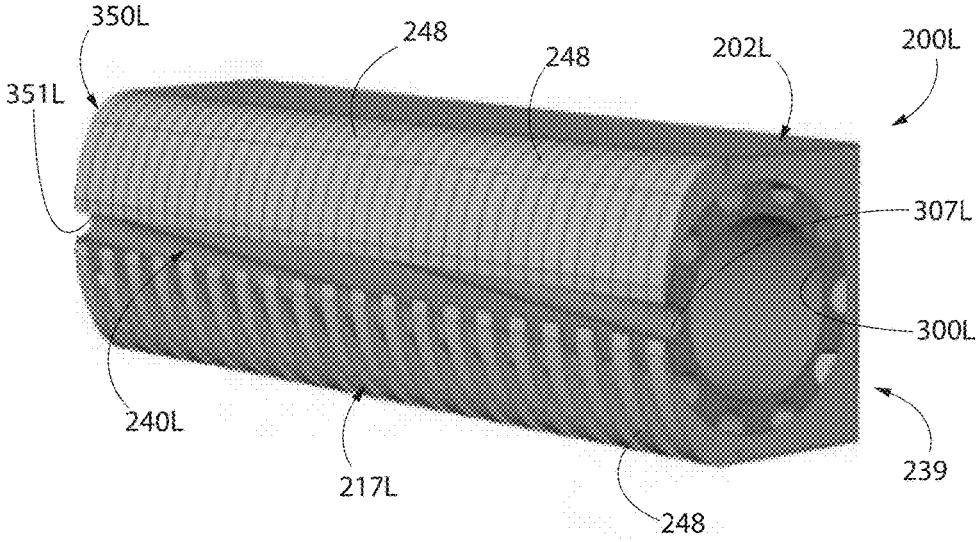
FIG. 30 is a perspective view of fourth alternative head comprising a housing formed of a plurality of stacked plate segments housing that can be used with the shaving apparatus of FIG. 1.
Figure 31:
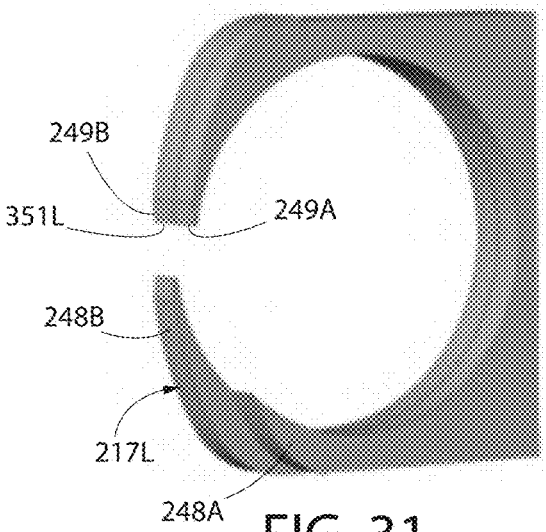
FIG. 31 is a perspective of two of the plate segments of FIG. 30.

Referring now to FIGS. 30-31 concurrently, a head 200L comprising a housing 202L formed of a plurality of stacked plate segments 248 is illustrated. The head 200L (along with its components) is identical to the head 200 of FIGS. 1-9 with the exception that the housing 202L is formed of a plurality of stacked plate segments 248 and the fixed blade is integrally formed with the housing 202L. Thus, the discussion of head 200L will be limited to those aspects that differ from the head 200 with the understanding that the discussion above is applicable thereto. Therefore, like reference numbers will be used to identify like elements with the addition of the alphabetical suffix "L."

The head 200L includes a comb 217L and is assembled from flat plate segments 248 that are arranged in a stack 239 to form the housing 202L. The flat plate segments 248 may be laser cut out of thin sheet metal. In one embodiment, the thickness of the flat plate segments 248 is defined by the thickness of the teeth of the comb 217L.

In one embodiment, each of the flat plate segments 248 comprise a central aperture having a center point. When arranged in the stack 239, the flat plate segments 248 are arranged so that their center points are aligned and the central apertures collectively define an internal cavity of the housing 202L.

The housing 202L is assembled from a plurality of first flat plate segments 248A having a first shape and a plurality of second flat plate segments 248B having a second shape. The first and second flat plate segments 248A, 248B are arranged in an alternating manner in the stack 239. This allows the comb 217L to be formed. Thus, the housing 202L has an integrally formed comb 217L and an integrally formed fixed blade 350L in certain embodiments. In one such embodiment, an edge 249A, 249B of each of the segments 248A, 248B is formed with sharp tip so that when the stack 239 is assembled, the edges 249A, 249B of each of the segments 248A, 248B collectively form the cutting edge 251L of the fixed cutting blade 250L that interacts with the cutting edges 307L to perform the shearing of hairs. In one embodiment, the head 202L may be formed of segments of different thicknesses.

Figure 32:
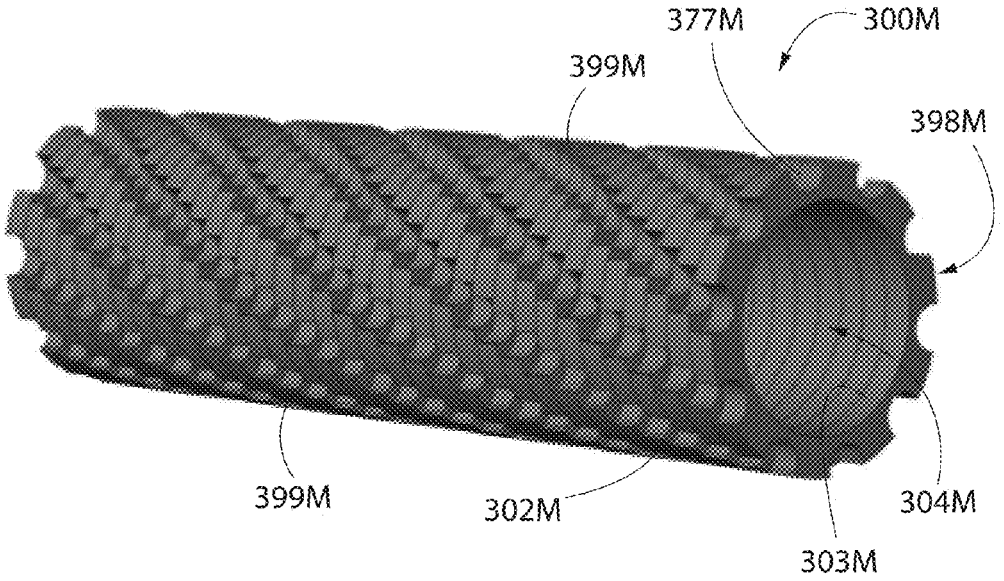
FIG. 32 is a perspective view of a rotary cutter that is formed by a plurality of stacked ring segments arranged in an angularly offset manner that can be used with the shaving apparatus of FIG. 1.
Figure 33:
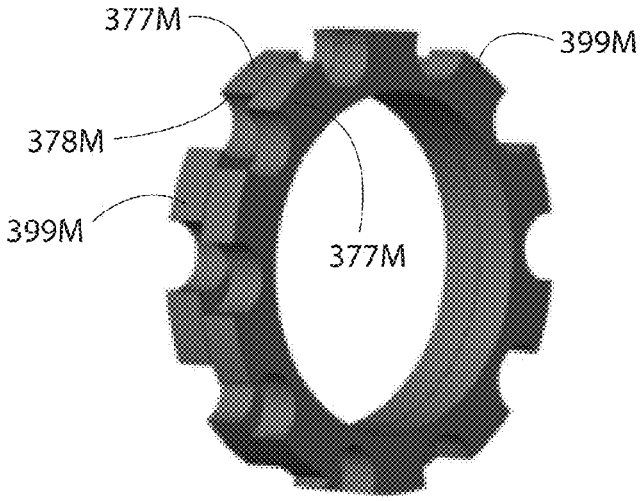
FIG. 33 is a perspective of two of the ring segments of FIG. 32.

Referring now to FIGS. 32-33 concurrently, a rotary cutter 300M that is formed by a plurality of stacked ring segments 399M is illustrated. The rotary cutter 300M can be sued with the shaving apparatus 1000 and is similar in some regards to the rotary cutter 300. Therefore, like reference numbers will be used to identify like elements with the addition of the alphabetical suffix "M."

The rotary cutter 300M is formed by a plurality of ring segments 399M that are arranged in a stack 398M to create the rotary cutter 300M. In one embodiment, each of the ring segments 399M comprises a central aperture having a center point. When arranged in the stack 398M, the ring segments 399M are arranged so that their center points are aligned and the central apertures collectively define a central cavity of the rotary cutter 300M.

Each segment 399M is formed with a plurality of evenly-spaced, outwardly-projecting ribs 377M that have cutting edges 378M on its outer surface. Each segment 399M is shifted by a small angle (e.g. 5° to 20°), i.e., angularly offset, with respect to its adjacent segment 399M in the stack 398M. In such an embodiment, the final form may be a step wise spiral. In the step wise spiral, the effective length of the cutting edges of the rotary cutter 399M have increased. In an embodiment, the segments 399M are identical. The segments 399M may be laser cut from thin sheet metal.

The intersection of the vertical and horizontal portion if each step has a very small radius, not economically achievable with standard manufacturing technologies. In an embodiment, the edges of the sheet metal segments 399M are "broken" or rounded. The intersection of the vertical and horizontal portion if each step has an undercut. In an embodiment, the segments 399M are assembled with a different rotation shift between segments 399M resulting in a step wise spiral whose average slope varies throughout the part. The step wise spiral average slope could change slightly, by a few degrees. In an embodiment, the segments 399M are assembled with a different rotation shift between segments resulting in a step wise spiral whose average slope varies throughout the rotary cutter 300M. The step wise spiral average slope could change direction, in a continuous line or a non-continuous.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A shaving apparatus comprising:
- a handle portion;
- a power source;
- an electric motor operably coupled to the power source and a rotary cutter to rotate the rotary cutter about a rotational axis;
- a head portion coupled to the handle portion, the head portion comprising:
  - the rotary cutter, the rotary cutter comprising a plurality of apertures in an outer surface of the rotary cutter, each of the apertures defined by a cutting edge having a closed-geometry and comprising a shearing portion and a non-shearing portion;
  - a fixed blade having a cutting edge, the fixed blade mounted adjacent the rotary cutter so that a user's hairs are sheared between the cutting edge of the fixed blade and the shearing portions of the cutting edges of the rotary cutter when the rotary cutter is rotating; and the apertures arranged in a pattern so that no more than two of the shearing portions are capable of being active in shearing the user's hair with the cutting edge of the fixed blade when the rotary cutter is rotating.

2. The shaving apparatus according to claim 1 wherein the pattern is such that only one of the shearing portions is active in shearing the user's hair with the cutting edge of the fixed blade when the rotary cutter is rotating.

3. The shaving apparatus according to claim 1 wherein the rotary cutter comprises a reference centerline; and wherein the pattern is such that the shearing portions that are active in shearing the user's hair with the cutting edge of the fixed blade when the rotary cutter is rotating comprises a first shearing portion and a second shearing portion, the first and second shearing portions located on opposite sides of the reference centerline.

4. The shaving apparatus according to claim 3 wherein the first and second shearing portions are located equidistant from the reference centerline.

5. The shaving apparatus according to claim 3 wherein the pattern is symmetric about the reference centerline.

6. The shaving apparatus according to claim 1 wherein for each of the apertures, the shearing portion comprises an angled section that is at an acute angle relative to a reference line on the outer surface of the rotary cutter that is parallel to the rotational axis.

7. The shaving apparatus according to claim 1 wherein for each of the apertures, the shearing portion comprises first and second angled sections that are each at an acute angle relative to a reference line on the outer surface of the rotary cutter that is parallel to the rotational axis, the first and second angled sections converging at an apex.

8. The shaving apparatus according to claim 1 wherein the rotary cutter comprises a cutter tube, the cutter tube comprising the outer surface of the rotary cutter.

9. The shaving apparatus according to claim 8 wherein the cutter tube comprises an inner surface, each of the apertures extending through the cutter tube from the outer surface of the rotary cutter to the inner surface of the cutter tube.

10. The shaving apparatus according to claim 9 wherein the rotary cutter further comprises a support tube, the cutter tube mounted on the support tube so that the inner surface of the cutter tube is in surface contact with an outer surface of the support tube; wherein the cutter tube is non-rotatable relative to the support tube.

11. The shaving apparatus according to claim 10 wherein the support tube comprises a plurality of depressions formed in the outer surface of the support tube; and wherein at least some of the apertures form passageways through the cutter tube into the depressions of the support tube.

12. The shaving apparatus according to claim 8 wherein the cutter tube is formed of a sheet metal.

13. A shaving apparatus comprising:

a handle portion;

a power source;

an electric motor operably coupled to the power source and a rotary cutter to rotate the rotary cutter about a rotational axis;

a head portion coupled to the handle portion, the head portion comprising:

the rotary cutter, the rotary cutter comprising a plurality of apertures in an outer surface of the rotary cutter, each of the apertures defined by a cutting edge having a closed-geometry and comprising a shearing portion and a non-shearing portion, the shearing portion comprising an apex;

a fixed blade having a cutting edge, the fixed blade mounted adjacent the rotary cutter so that a user's hairs are sheared between the cutting edge of the fixed blade and the shearing portions of the cutting edges when the rotary cutter is rotating; and the apertures arranged in a pattern so that a projected reference line of the cutting edge of the fixed blade on the outer surface of the rotary cutter intersects no more than two of the apexes irrespective of angular position of the rotary cutter.

14. The shaving apparatus according to claim 13 wherein the projected reference line is linear and parallel to the rotational axis.

15. The shaving apparatus according to claim 13 wherein the pattern is such that the projected reference line of the cutting edge of the fixed blade on the outer surface of the rotary cutter intersects only one of the apexes irrespective of the angular position of the rotary cutter.

16. The shaving apparatus according to claim 13 wherein the rotary cutter comprises a reference centerline, wherein the pattern is such that the projected reference line of the cutting edge of the fixed blade on the outer surface of the rotary cutter intersects a first apex of the shearing portion of a first one of the plurality of apertures and a second apex of the shearing portion of a second one of the plurality of apertures irrespective of the angular position of the rotary cutter; and wherein the first and second apexes are located on opposite sides of the reference centerline.

17. The shaving apparatus according to claim 16 wherein the first and second apexes are located equidistant from the reference centerline.

18. The shaving apparatus according to claim 16 wherein the pattern is symmetric about the reference centerline.

* * * * *